United States Patent [19]

Kato et al.

[11] Patent Number: 4,626,499

[45] Date of Patent: Dec. 2, 1986

[54] HEAT DEVELOPABLE LIGHT-SENSITIVE MATERIAL

[75] Inventors: Masatoshi Kato; Hiroshi Kitaguchi, both of Kanagawa, Japan

[73] Assignee: Fuji Photo Film Co., Ltd., Kanagawa, Japan

[21] Appl. No.: 727,978

[22] Filed: Apr. 26, 1985

[30] Foreign Application Priority Data

Apr. 27, 1984 [JP] Japan ..... 59-85836

[51] Int. Cl.[4] ..... G03C 1/02

[52] U.S. Cl. ..... 430/559; 430/562; 430/619; 430/620; 430/203

[58] Field of Search ..... 430/619, 620, 203, 559, 430/562, 561

[56] References Cited

U.S. PATENT DOCUMENTS

| | | | |
|---|---|---|---|
| 4,499,180 | 2/1985 | Hirai et al. | 430/619 |
| 4,500,626 | 2/1985 | Naito et al. | 430/203 |
| 4,536,467 | 8/1985 | Sakaguchi et al. | 430/619 |

*Primary Examiner*—Won H. Louie

*Attorney, Agent, or Firm*—Sughrue, Mion, Zinn, MacPeak and Seas

[57] ABSTRACT

A heat developable light-sensitive material is described, comprising a support having thereon a light-sensitive silver halide emulsion, a base or a base precursor, and a compound containing a group bonded to a carbon atom is represented by formula (I)

(I)

wherein $R^2$ represents an aryl group, a substituted aryl group, a heterocyclic group or a group represented by formula (A), (B), or (C)

(A)

(B)

(C)

wherein $R^{11}$ through $R^{16}$ each represents an alkyl group, a substituted alkyl group, an aryl group, or a substituted aryl group.

14 Claims, No Drawings

HEAT DEVELOPABLE LIGHT-SENSITIVE MATERIAL

FIELD OF THE INVENTION

This invention relates to a heat developable light-sensitive material, and more particularly to a heat developable light-sensitive material showing stable photographic properties after development processing.

BACKGROUND OF THE INVENTION

Photographic processes using silver halide have hitherto been most widely used for general photographic purposes, since such processes are excellent in photographic characteristics such as sensitivity and gradation control as compared to other photographic processes, such as electrophotography and diazo photographic process. Recently, techniques capable of easily and quickly obtaining images by changing the image forming process of a light-sensitive material using silver halide from a conventional wet processing by a developer, etc., to a dry process by heating, etc., have been developed.

Heat developable light-sensitive materials are known in this art field and, heat developable light-sensitive materials and the image forming process using these materials are described, for example, in *Shashin Kogaku no Kiso* (*The Foundation of Photographic Technology*), pages 553–555 (published by Corona K. K., 1979); *Eizo Jyoho* (*Image Information*), page 40, published April, 1978; *Neblette's Handbook of Photography and Reprography,* 7th Ed., pages 32–33 (published by Van Nostrand Reinhold Company, 1977); U.S. Pat. Nos. 3,152,904, 3,301,678, 3,392,020 and 3,457,075, British Pat. Nos. 1,131,108 and 1,167,777, and *Research Disclosure,* June 1978, pages 9–15 (RD-17029).

Various processes have been proposed for obtaining color images. For example, processes for forming color images by a combination of the oxidation product of a developing agent and couplers that have been proposed include a combination of a p-phenylenediamine series reducing agent and a phenolic or active methylene coupler as described in U.S. Pat. No. 3,531,286; a combination of a p-aminophenolic reducing agent and a coupler as described in U.S. Pat. No. 3,761,270; a combination of a sulfonamidophenolic reducing agent and a coupler as described in Belgian Pat. No. 802,519 and *Research Disclosure,* September, 1975, pages 31 and 32; and a combination of a sulfonamidophenolic reducing agent and a 4-equivalent coupler as described in U.S. Pat. No. 4,021,240.

Also, with respect to processes for forming positive color images by a light-sensitive silver dye bleaching process, useful dyes and bleaching processes using the dyes are described, for example, in *Research Disclosure,* April, 1976, pages 30–32 (RD-14433); ibid., December, 1976, pages 14–15 (RD-15227); U.S. Pat. No. 4,235,957, etc.

Furthermore, an image-forming process by heat development utilizing a compound previously having a dye moiety and capable of releasing a mobile dye in correspondence or countercorrespondence to the recuction reaction of silver halide to silver in a high temperature state have been disclosed in European Patent Published Application Nos. 76,492 A and 79,056 A and Japanese Patent Application (OPI) Nos. 28928/83 and 26008/83 (the term "OPI" as used herein refers to a "published unexamined Japanese patent application open to public inspection").

In these heat developable light-sensitive materials as described above, the development is performed by applying heat using, in many cases, a base as the development accelerator. However, there are problems in that it takes a considerable period of time to reduce the temperature of the light-sensitive material once heated to a high temperature, whereby the development sometimes proceeds excessively to reduce the image quality, and also even by a same heating pattern, the progress of the development deviates due to even small variations in conditions such as the environmental temperature, the heating temperature, the water content of the light-sensitive material, the heating time, etc.

As similar techniques for avoiding the occurrence of such undesirable development, a process of using an acid polymer for neutralization has been proposed in a diffusion transfer process as described, for example, in *Research Disclosure,* Vol. 123, page 22; ibid., Vol. 180, page 18030; British Pat. No. 2,082,787 A. However, when this process is applied to a heat developable light-sensitive material, the density of the image obtained is reduced, since the base is quickly neutralized. Also, as a compound releasing an acid upon heating, an acid component which is dissolved or releases a volatile acid at a temperature higher than 60° C. is described in Japanese Patent Application (OPI) Nos. 58642/74 and 57452/75, but when the compounds proposed in these patent applications are applied to heat developable light-sensitive materials, the compounds neutralize bases before initiating the development by heating, whereby the development is inhibited to reduce the density of the images obtained.

SUMMARY OF THE INVENTION

An object of this invention, therefore, is to provide a novel heat developable color light-sensitive material capable of stopping the development when the development has sufficiently proceeded without reducing the density of images thus formed.

That is, it is an object of this invention to provide a heat developable light-sensitive material containing a compound which is very stable at normal room temperature (20° C.) and which can stop the development by reacting with a base upon heat development to reduce the concentration of the base in the heat developable light-sensitive layer.

Another object of this invention is to provide a heat developable light-sensitive material providing an image having a high S/N ratio (i.e., signal/noise ratio wherein the signal means image and the noise means fog) and high image density.

As a result of extensive investigations, the inventors have discovered that the aforesaid objects of this invention can be attained by the present invention as set forth below.

That is, according to this invention, a heat developable light-sensitive material is provided comprising a support having thereon at least a light-sensitive silver halide emulsion, a base or a base precursor, and a compound containing a group bonded to a carbon atom which is represented by formula (I)

$$-\overset{\overset{\displaystyle O}{\|}}{C}-O-R^2 \qquad \text{(I)}$$

wherein $R^2$ represents an aryl group, a substituted aryl group, a heterocyclic group, or a group represented by formula (A), (B), or (C)

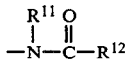

(A)

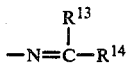

(B)

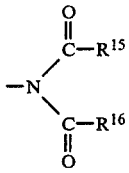

(C)

wherein $R^{11}$ through $R^{16}$ each represents an alkyl group, a substituted alkyl group, an aryl group, or a substituted aryl group.

DETAILED DESCRIPTION OF THE INVENTION

It is preferred that the group represented by formula (I) above is bonded to a carbon atom included in an alkyl group, a substituted alkyl group, a cycloalkyl group, an alkenyl group, a alkynyl group, an aralkyl group, an aryl group, a substituted aryl group or a heterocyclic group (hereinafter these groups are referred to as "$R^1$"). The compound containing a group represented by formula (I) according to this invention may contain two or more groups represented by formula (I). It is preferred that the compound has from 1 to 3 groups represented by formula (I).

The compounds containing a group represented by formula (I) according to this invention are explained below in more detail.

The alkyl group for $R^1$ is preferably a straight chain or branched chain alkyl group containing from 1 to 18 carbon atoms, and specific examples of such alkyl groups are a methyl group, an ethyl group, an n-propyl group, an n-butyl group, an n-hexyl group, an n-hexyl group, a 2-ethylhexyl group, an n-decyl group, an n-dodecyl group, etc. Examples of the substituent in the case of a substituted alkyl group include a halogen atom, an alkoxy group, an aryloxy group, a cyano group, an alkylthio group, an arylthio group, a substituted or unsubstituted carbamoyl group, an alkylsulfonyl group, an arylsulfonyl group, a di-substituted amino group substituted by alkyl groups or aryl groups, a nitro group, a substituted or unsubstituted sulfamoyl group, etc.

The cycloalkyl group for $R^1$ is preferably a 5-membered or 6-membered cycloalkyl group having a total of from 5 to 10 carbon atoms, such as a cyclopentyl group, a cyclohexyl group, etc.

Examples of the alkenyl group for $R^1$ are a vinyl group, an allyl group, a crotyl group, or a substituted or unsubstituted styryl group.

Examples of the alkynyl group for $R^1$ are a propionyl group, a substituted or unsubstituted phenylpropionyl group, etc.

Examples of the aralkyl group for $R^1$ are a benzyl group, a $\beta$-phenethyl group, etc.

The aryl group for $R^1$ is preferably an aryl group containing from 6 to 18 carbon atoms, such as a phenyl group, a naphthyl group, an anthryl group, etc. Examples of the substituent in the case of a substituted aryl group include a substituted or unsubstituted alkyl group, a substituted or unsubstituted alkoxy group, a substituted or unsubstituted aryl group, a halogen atom, a di-substituted amino group substituted by alkyl groups or aryl groups, an acylamino group, a sulfonylamino group, a cyano group, a nitro group, an alkylthio group, an arylthio group, an alkylsulfonyl group, an arylsulfonyl group, an oxycarbonyl group, a carbonyloxy group, a hydroxy group, a substituted or unsubstituted carbamoyl group, a substituted or unsubstituted sulfamoyl group, etc.

The heterocyclic group for $R^1$ is preferably a 5-membered or 6-membered heterocyclic ring group containing at least one of oxygen, nitrogen, or sulfur as a hetero atom, and examples of such groups are a pyridyl group, a furyl group, a thienyl group, a pyrrole group, an indolyl group, etc. Also, the heterocyclic group may include a substituent selected from the same substituents defined for the substituted aryl group described above.

The aryl group, substituted aryl group, and heterocyclic group represented by $R^2$ in the aforesaid formula (I) are preferably those as described for $R^1$ hereinbefore. Also, $R^{11}$ through $R^{16}$ of the above-described formulae (A), (B), and (C) each represents an alkyl group, a substituted alkyl group, an aryl group, or a substituted aryl group, and these groups are preferably those as described for $R^1$ hereinbefore. Also, $R^{15}$ and $R^{16}$ may combine with each other to form a ring.

Preferred example of the above-described compound containing the group represented by formula (I) according to this invention is represented by the following formula (II)

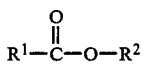

(II)

wherein $R^1$ and $R^2$ are the same meaning as defined above.

A first feature of this invention is to use the above-described compound of this invention for the purpose of stopping the development together with a base or a base precursor for accelerating the development for the heat developable light-sensitive material of this invention.

A second feature of this invention is that $R^2$ in the compound has the above-described structure and the pKa of $R^2$—OH (which is formed during the heat development by the reaction of the compound of the present invention with the base) is lower than that of a general alkylalcohol.

The above-described compound containing a group represented by formula (I) according to this invention is very stable at normal temperature but can stop development by causing a reaction with a base upon heat development to reduce the concentration of the base in the heat developable light-sensitive layer. For example, when the base is an amine, the compound in this invention causes the following reaction (1) upon heat development.

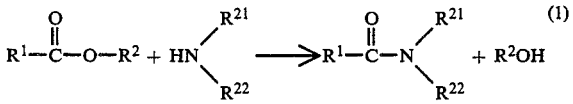

(1)

In the foregoing, $R^1$ represents an alkyl group, a substituted alkyl group, a cycloalkyl group, an alkenyl group, an alkynyl group, an aralkyl group, an aryl group, a substituted aryl group, or a heterocyclic residue; $R^2$ has the same meaning as defined above and $R^{21}$ and $R^{22}$ each represents an aliphatic or aromatic group.

It is known that such a reaction can generally occur with respect to a compound having an electrophilic moiety, but in many carboxylic acid esters which are used as dispersing oils, etc., for light-sensitive materials, $R^2$ of formula (I) is a long chain alkyl group, and in such compounds, the pKa of $R^2$—OH is rather high. Thus, in the case of using these conventional compounds, the reaction rate of the reaction shown by the reaction equation (1) described above is rather slow and the reaction cannot effectively occur upon heat development. On the other hand, it has now been found according to the present invention that in the case of using the compound containing a group represented by formula (I) according to this invention, the reaction shown by the reaction equation (1) occurs effectively upon heat development, due to the low pKa of $R^2$—OH, to reduce the concentration of base in the heat developable light-sensitive layer, whereby the development is effectively stopped.

Also, the reaction of the compound in this invention and a base shown by equation (1) usually would be considered as a solution reaction, but is has unexpectedly been found that the reaction effectively occurs in a short period of time even in a dry layer upon heat development.

Specific examples of the compound for use in this invention are illustrated below, but the invention is not limited thereto.

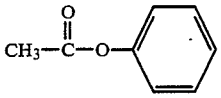

Compound (1)

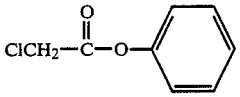

Compound (2)

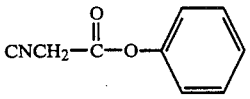

Compound (3)

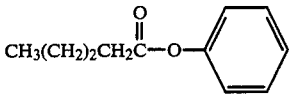

Compound (4)

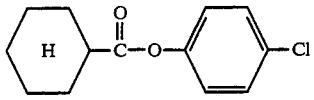

Compound (5)

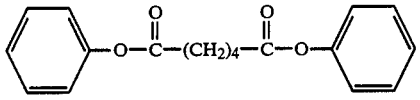

Compound (6)

-continued

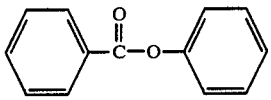

Compound (7)

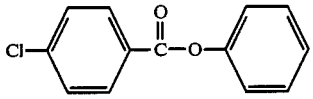

Compound (8)

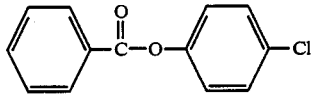

Compound (9)

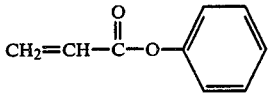

Compound (10)

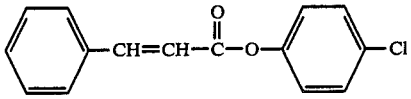

Compound (11)

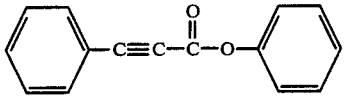

Compound (12)

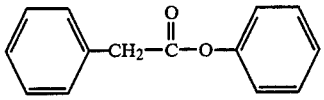

Compound (13)

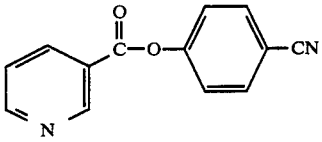

Compound (14)

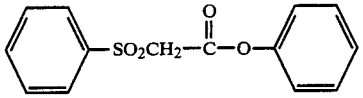

Compound (15)

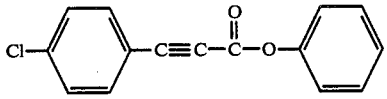

Compound (16)

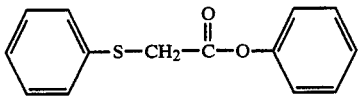

Compound (17)

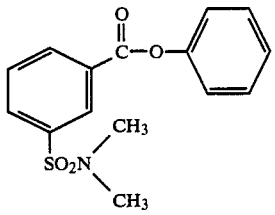

Compound (18)

-continued
Compound (19)
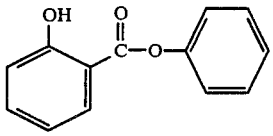
Compound (20)
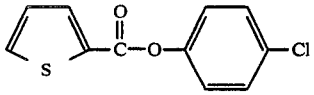
Compound (21)
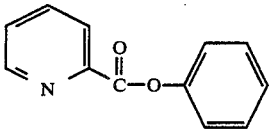
Compound (22)
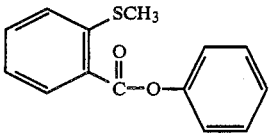
Compound (23)
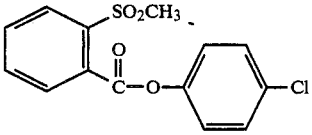
Compound (24)
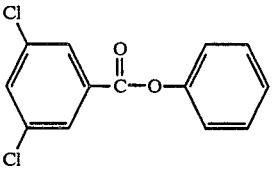
Compound (25)
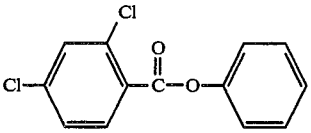
Compound (26)
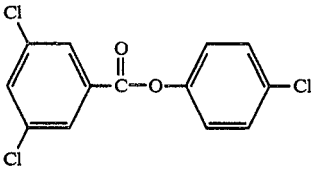
Compound (27)
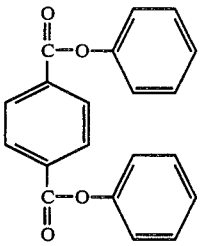
-continued
Compound (28)
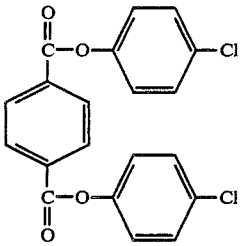
Compound (29)
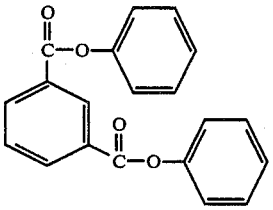
Compound (30)
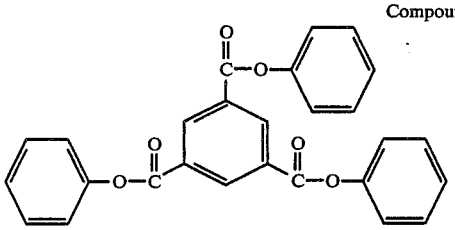
Compound (31)
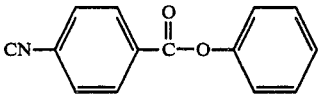
Compound (32)
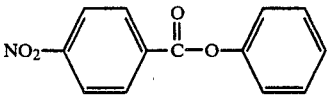
Compound (33)
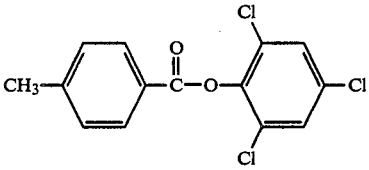
Compound (34)
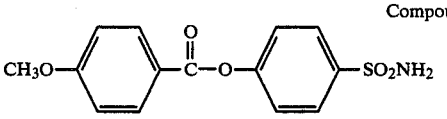
Compound (35)
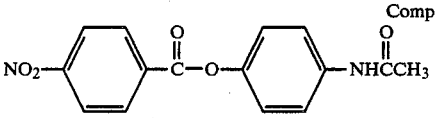
Compound (36)
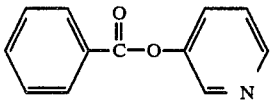

-continued
Compound (37)
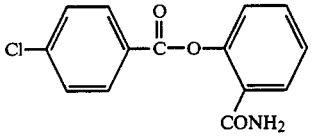
Compound (38)
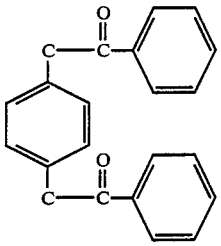
Compound (39)
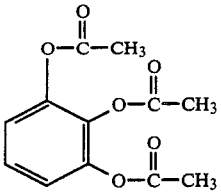
Compound (40)
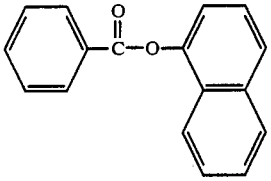
Compound (41)
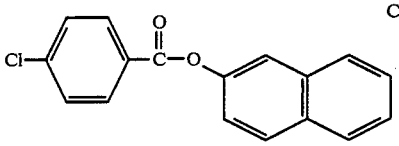
Compound (42)
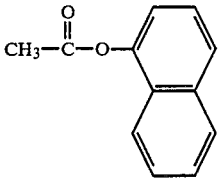
Compound (43)
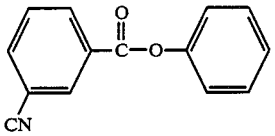
Compound (44)
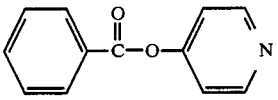
Compound (45)
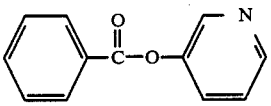
-continued
Compound (46)
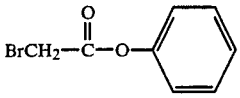
Compound (47)
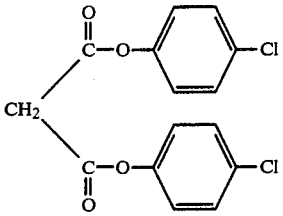
Compound (48)
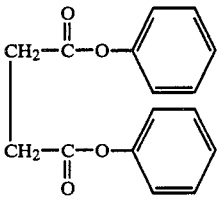
Compound (49)
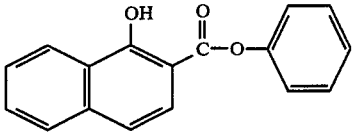
Compound (50)
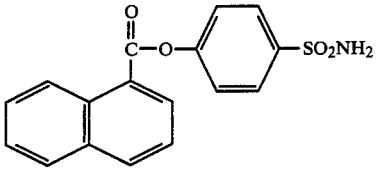
Compound (51)
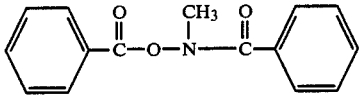
Compound (52)
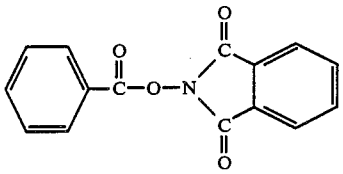
Compound (53)
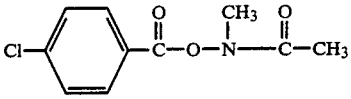
Compound (54)
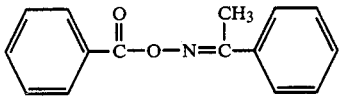
Compound (55)
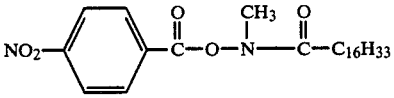

-continued

Compound (56)

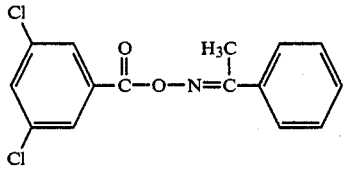

Compound (57)

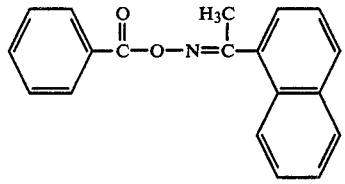

Compound (58)

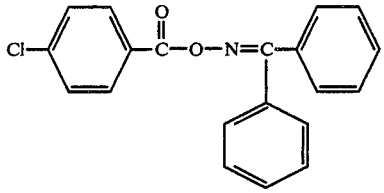

Compound (59)

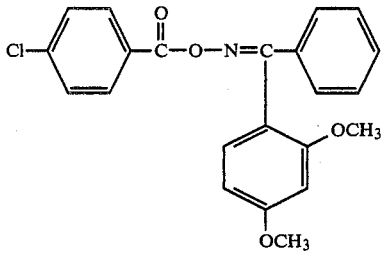

Compound (60)

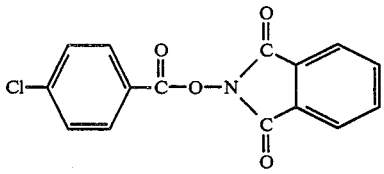

Compound (61)

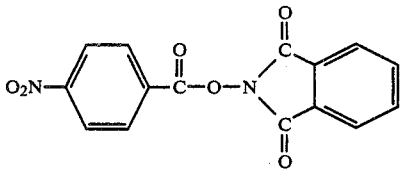

Compound (62)

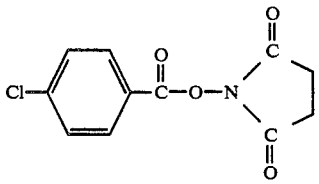

-continued

Compound (63)

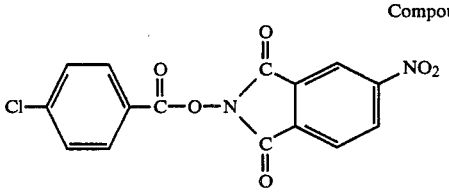

Synthesis processes for compounds containing a group represented by formula (I) according to this invention are described below.

Carboxylic acid ester type compounds can be prepared by well-known reactions, and synthesis processes of the compounds are described in detail, for example, in Patai, Ed., *The Chemistry of Carboxylic Acids and Esters* (published by Interscience Co.); Sandler and Karo, *Organic Functional Group Preparations,* pages 246–265 (published by Academic Press Co.); Wagner and Zook, *Synthetic Organic Chemistry* (published by John Wiley & Sons Co.); *Shin Jikken Kagaku Koza* (*New Experimental Chemistry Course*) (14), *Synthesis and Reaction of Organic Compounds* (*II*), pages 1000–1061, edited by the Chemical Society of Japan, etc. Generally, such compounds are synthesized by a condensation reaction of a corresponding carboxylic acid or a related compound (acid halide, acid anhydride, etc.) and $R^2$—OH. Of these processes, preferred processes are as follows:

(a) Condensation with a carboxylic acid using an acid catalyst:

$$R^1\text{—}CO_2H + R^2\text{—}OH \underset{}{\overset{H^+}{\rightleftharpoons}} R^1\text{—}\overset{O}{\overset{\|}{C}}\text{—}O\text{—}R^2 + H_2O$$

(b) Condensation with acid halide:

$$R^1\text{—}COX + R^2\text{—}OH \longrightarrow R^1\text{—}\overset{O}{\overset{\|}{C}}\text{—}O\text{—}R^2 + HX$$

wherein X represents a halogen atom.

This reaction is frequently performed using a base as a deoxidizing agent to remove HX.

(c) Condensation with acid anhydride:

$$R^1\text{—}\overset{O}{\overset{\|}{C}}\text{—}O\text{—}\overset{O}{\overset{\|}{C}}\text{—}R^3 + R^2\text{—}OH \longrightarrow R^1\text{—}\overset{O}{\overset{\|}{C}}\text{—}O\text{—}R^2 + R^3\text{—}CO_2H$$

wherein $R^1$ and $R^3$ may be the same or different, $R^1$ and $R^3$ each has the same meaning as defined for $R^1$ hereinbefore.

(d) Condensation using dicyclohexylcarbodiimide (DCC):

$$R^1\text{—}CO_2H + R^2\text{—}OH \xrightarrow{DCC} R^1\text{—}\overset{O}{\overset{\|}{C}}\text{—}O\text{—}R^2 +$$

-continued

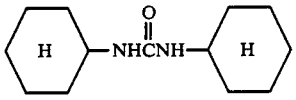

Specific synthesis examples for the compounds are shown below.

SYNTHESIS EXAMPLE 1

Synthesis of Compound (1)

Compound (1) was obtained by acetylating phenol with acetic anhydride according to the process described in *Journal of the Chemical Society,* 2495 (1931). The melting point was 196° C.

SYNTHESIS EXAMPLE 2

Synthesis of Compound (7)

Compound (7) was obtained by azeotropically dehydrocondensing benzoic acid and phenol in toluene using boric acid and sulfuric acid as the catalyst according to the process described in *Tetrahedron Lett.,* p. 3453 (1971). The melting point was 80° C.

SYNTHESIS EXAMPLE 3

Synthesis of Compound (9)

After cooling 100 ml of an aqueous solution containing 28.3 g (0.22 mol) of p-chlorophenol and 9.8 g (0.23 mol) of 93% sodium hydroxide to below 10° C. with stirring, 33 g (0.24 mol) of benzoyl chloride was added dropwise to the solution while maintaining the solution at less than 10° C., and thereafter the reaction was performed for 30 minutes at room temperature (about 20° C.). Then, crystals thus deposited were collected by filtration and washed with water. By recrystallizing the crude crystals thus obtained from methanol, 46.8 g (0.2 mol) of Compound (9) was obtained. The yield was 91% and the melting point was 84°–85° C.

SYNTHESIS EXAMPLE 4

Synthesis of Compound (24)

After cooling 150 ml of an acetonitrile solution containing 21.6 g (0.23 mol) of phenol and 24.2 g (0.24 mol) of triethylamine to below 10° C., 50 g (0.24 mol) of 3,5-dichlorobenzoyl chloride was added dropwise to the solution while maintaining the system at less than 10° C. Thereafter, the reaction was further performed for 30 minutes at room temperature and the reaction mixture was poured into 500 ml of water. Crystals thus deposited were collected by filtration and washed with water. By recrystallizing the crude crystals thus obtained from a mixed solvent of isopropyl alcohol and ethyl acetate (5/1 by volume ratio), 55.8 g of Compound (24) was obtained. The yield was 91% and the melting point was 127°–128° C.

SYNTHESIS EXAMPLE 5

Synthesis of Compound (27)

After cooling 1 liter of a methylene chloride solution containing 94 g (1 mol) of phenol and 101 g (1 mol) of triethylamine to below 10° C., 101.5 g (0.5 mol) of terephthaloyl chloride was added to the solution as a solid while maintaining the system at less than 10° C. Thereafter, after further performing the reaction for 2 hours at room temperature, 1 liter of water and 2 liters of methylene chloride were added to the reaction mixture thus obtained to perform extraction, and the methylene chloride layer thus formed was separated. The methylene chloride solution thus obtained was concentrated at normal pressure to about 300 ml, and after adding 400 ml of ethyl acetate and 100 ml of methanol thereto, the mixture was ice-cooled. Crystals thus deposited were collected by filtration and washed with a mixed solvent of ethyl acetate and methanol (4/1 by volume ratio) to provide 142 g (0.446 mol) of Compound (27). The yield was 89% and the melting point was 190°–190.5° C.

SYNTHESIS EXAMPLE 6

Synthesis of Example (39)

Compound (39) was obtained by acetylating pyrogallol with acetic anhydride according to the process described in *Journal of the Chemical Society,* p. 2495 (1931). The melting point was 172°–173° C.

SYNTHESIS EXAMPLE 7

Synthesis of Compound (51)

Compound (51) was obtained by reacting N-methylhydroxylamine and benzoyl fluoride in an aqueous solution of sodium hydroxide and recrystallizing the product thus formed from ethanol according to the process described in *Liebigs Annalen der Chemie,* Vol. 365, page 212. The melting point was 56° C.

SYNTHESIS EXAMPLE 8

Synthesis of Compound (54)

To 200 ml of an acetonitrile solution containing 20 g (0.148 mol) of acetophenone oxime was added 7.1 g (0.15 mol) of 50% oily sodium hydride followed by stirring. After the generation of hydrogen gas stopped, the reaction mixture was cooled to below 10° C. and 23 g (0.16 mol) of benzoyl chloride was added dropwise to the mixture while maintaining the system at less than 10° C. Thereafter, after further performing the reaction for 30 minutes at room temperature, water was added to the reaction mixture and crystals thus formed were collected by filtration and washed with water. The crude crystals thus obtained were recrystallized from a mixture of n-hexane and ethyl acetate (5/1 by volume ratio) to provide 27.0 g (0.113 mol) of Compound (54). The yield was 76% and the melting point was 97°–98° C.

The amount of the compound for use in this invention differs according to the kind of the compound and the system to be used and is generally less than 50% by weight of the weight of the coated layer, preferably in the range of less than 30% by weight. Also, the compounds for use in this invention may be used singly or as a combination thereof. Furthermore, the compound in this invention can be used with other development stopping agents or a development stopping technique as described in Japanese Patent Application (OPI) Nos. 182448/84 and 188644/84.

The compound containing a group represented by formula (I) according to this invention may be added to a binder as a solution in an organic solvent that is solube in water (e.g., methanol, ethanol, acetone, dimethylformamide, etc.), or a mixture of such organic solvent and water.

The compound may be further added to a binder as fine particles thereof.

Preferred compounds containing a group represented by formula (I) according to this invention are compounds that are decomposed by the time of proper development (i.e., at the time immediately before the fog level increases) in an amount of less than 80%, preferably less than 50%, more preferably less than 20%.

In this invention, a base or a base precursor is used as a dye releasing assistant.

The base or the precursor thereof can be used in the light-sensitive material or in a dye fixing material. In the case of incorporation in the light-sensitive material, the use of the base precursor form is advantageous.

The terminology "base precursor" refers to a material releasing a basic component by heating. The basic component released in this case may be an inorganic base or an organic base described hereinbelow.

Examples of the preferred inorganic base for use in this invention are hydroxides of alkali metals or alkaline earth metals; secondary or tertiary phosphates of alkali metals or alkaline earth metals; borates of alkali metals or alkaline earth metals; carbonates of alkali metals or alkaline earth metals; quinolinates of alkali metals or alkaline earth metals; metaborates of alkali metals or alkaline earth metals; ammonium hydroxide; a hydroxide of a quaternary alkylammonium; and hydroxides of other metals. Examples of preferred organic bases are aliphatic amines, aromatic amines, heterocyclic amines, amidines, cyclic amidines, guanidines, cyclic guanidines, etc. Bases having a pKa of higher than 8 are particularly advantageous in this invention.

As the base precursor, a compound releasing a base by undergoing a reaction upon heating, such as a salt of an organic acid and a base capable of decarboxylating or decomposing by heating, or a compound releasing an amine by decomposing by a Lossen rearrangement or a beckmann rearrangement is used.

Examples of the preferred base precursors are the precursors of the aforesaid organic bases, such as salts of heat decomposable organic acids such as trichloroacetic acid, propionic acid, cyanoacetic acid, sulfonylacetic acid, acetoacetic acid, etc., and the salt of 2-carboxycarboxamide as described in U.S. Pat. No. 4,088,496.

Specific examples of the preferred bases are described below, but the bases for use in this invention are not limited thereto. Examples include lithium hydroxide, sodium hydroxide, potassium hydroxide, barium hydroxide, sodium carbonate, potassium carbonate, sodium quinolinate, potassium quinolinate, sodium secondary phosphate, potassium secondary phosphate, sodium tertiary phosphate, potassium tertiary phosphate, sodium pyrophosphate, potassium pyrophosphate, sodium metaborate, potassium metaborate, borax, ammonium hydroxide, tetramethyl ammonium, tetrabutyl ammonium, ammonia, $MeNH_2$ (wherein Me represents $CH_3$ and so forth), $Me_2NH$, $EtNH_2$ (wherein Et represents $C_2H_5$ and so forth), $Et_2NH$, $C_4H_9NH_2$, $(C_4H_9)_2NH$, $HOC_2H_4NH_2$, $(HOC_2H_4)_2NH$, $Et_2NCH_2CH_2OH$, $H_2NC_2H_4NH_2$, $MeNHC_2H_4NHMe$, $Me_2NC_2H_4NH_2$, $H_2NC_3H_6NH_2$, $H_2NC_4H_8NH_2$, $H_2NC_5H_{10}NH_2$, $Me_2NC_2H_4NMe_2$, $Me_2NC_3H_6NMe_2$,

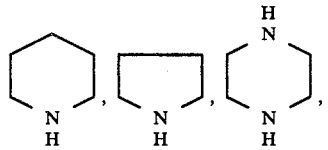

-continued

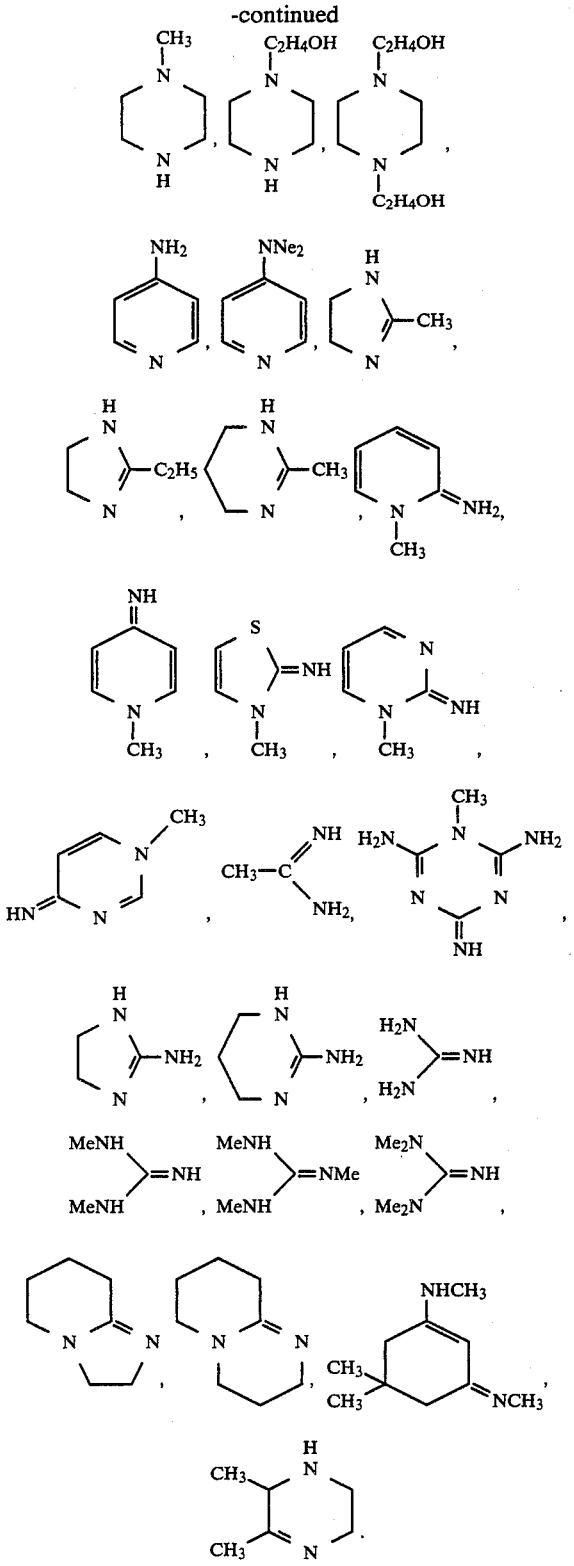

Specific examples of preferred base precursors are described below, but the base precursors for use in this invention are not limited thereto. In such a compound, the acid moiety is considered to undergo a decarboxylation to release a base. Examples include trichloroacetic acid derivatives such as guanidinetrichloroacetic acid, piperidinetrichloroacetic acid, morpholinetrichloroacetic acid, p-toluidinetrichloroacetic acid, 2-picolinertrichloroacetic acid, etc.

Other useful base precursors are described, e.g., in British Pat. No. 998,945, U.S. Pat. No. 3,220,846, Japanese Patent Application (OPI) No. 22625/75, etc.

Other base precursors in addition to those that are trichloroacetic acid derivatives, such as 2-carboxycarboxamide derivatives described in U.S. Pat. No. 4,088,496, the α-sulfonyl acetate derivatives described in U.S. Pat. No. 4,060,420, and the salts of propiolic acid derivatives and bases described in Japanese Patent Application (OPI) No. 180537/84 can also be used in this invention. Salts using alkali metals or alkaline earth metals other than organic bases can be effectively used as the base component in this invention and are described in Japanese Patent Application (OPI) No. 195237/84.

As precursors other than the above-described base precursors, hydroxamcarbamates utilizing a Lossen rearrangement as described in Japanese Patent Application (OPI) No. 168440/84 and the aldoximecarbamates described in Japanese Patent Application (OPI) No. 157637/84 can also be effectively used.

Also, the amineimides described in *Research Disclosure,* No. 15776, May 1977, and the aldonamines described in Japanese Patent Application (OPI) No. 22625/75 are decomposed at high temperature to form bases and are preferably used as the base precursors in this invention.

These bases and base precursors can be used over a wide range with respect to the amount thereof. The useful range of the amount of the base or the base precursor is less than 50% by weight, and preferably the amount is in the range of from 0.01% by weight to 40% by weight, based on the total weight of the coated layer of the light-sensitive material.

The compound containing a group represented by formula (I) according to this invention and the base or base precursor may be present in the same layer or in different layers. Examples of such layer or layers are a light-sensitive silver halide emulsion layer, an interlayer, a protective layer, and a subbing layer.

In this invention, silver may be used as an image forming material, or various other image forming materials may be used. For example, there are couplers forming dye images by combining with the oxidation product of a developing agent used for liquid developing processing. Examples of magneta couplers (i.e., magenta-color-forming-couplers) include 5-pyrazolone couplers, pyrazolobenzimidazole couplers, cyanoacetylcumarone couplers, open chain acylacetonitrile couplers, etc.; examples of yellow couplers include acylacetanilide couplers (e.g., benzoylacetanilides, pivaloylacetanilides, etc.) etc.; and examples of cyan couplers include napthol coulers, phenol couplers, etc.

It is preferred that these couplers are non-diffusible couplers having a hydrophilic group called a ballast group in the molecule, or are polymerized couplers. The couplers may be 4-equivalent or 2-equivalent with respect to the silver ion. Also, colored couplers having a color correction effect, or so-called DIR (development inhibitor releasing) couplers releasing a development inhibitor with the progress of the development may be used in this invention.

Also, dyes forming positive color images by a light-sensitive silver dye bleaching process, such as the dye described, for example, in *Research Disclosure,* April, 1976, pages 30–32 (RD-14433), ibid., December, 1976, pages 14–15 (RD-15227), and U.S. Pat. No. 4,235,957, and the leuco dyes described in U.S. Pat. Nos. 3,985,565 and 4,022,617 can be used in this invention.

Furthermore, dyes having introduced therein a nitrogen-containing heterocyclic group, as described in *Research Disclosure,* May, 1978, pages 54–58 (RD-16966), can also be used in this invention.

Moreover, the dye providing materials releasing a mobile dye by utilizing a coupling reaction with a reducing agent oxidized by the oxidation reduction reaction with silver halide or an organic silver salt at high temperature, as described in European Pat. No. 79,056, West German Pat. No. 3,217,853, and European Pat. No. 67,455, and also the dye providing materials releasing a mobile dye as a result of the oxidation reduction reaction with silver halide or an organic silver salt at high temperatures as described in European Pat. No. 76,492, West German Pat. No. 3,215,485, European Pat. No. 66,282, and Japanese Patent Application (OPI) Nos. 154445/84 and 152440/84 can also be used in this invention.

The dye providing material for use in this invention is preferably represented by formula (C I)

$$(\text{Dye}—X)_q—Y \qquad \text{(C I)}$$

wherein Dye represents a dye which becomes mobile when it is released from the molecule of the compound represented by formula (C I); X represents a simple bond or a connecting group; Y represents a group which releases Dye in correspondence or countercorrespondence to lightsensitive silver salts having a latent image distributed imagewise, the diffusibility of Dye released being different from that of the compound represented by formula (C I) and q represents an integer of 1 or 2.

The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes and phthalocyanine dyes, etc. These dyes can also be used in the form of having temporarily shorter wavelengths, the color of which is recoverable in the development processing.

More specifically, the dyes as described in European Patent Published Application No. 76,492A can be utilized.

Examples of the connecting group represented by X include —NR— (wherein R represents a hydrogen atom, an alkyl group, or a substituted alkyl group), $—SO_2—$, —CO—, an alkylene group, a substituted alkylene group, a phenylene group, a substituted phenylene group, a naphthylene group, a substituted naphthylene group, —O—, —SO—, or a group derived by combining together two or more of the foregoing groups.

In the following, preferred embodiments of Y in formula (C I) are described in greater detail.

In one embodiment, Y is selected so that the compound represented by formula (C I) is a nondiffusible image forming compound which is oxidized as a result of development, thereby undergoing self-cleavage and releasing a diffusible dye.

An example of Y which is effective for compounds of this type is an N-substituted sulfamoyl group. For example, a group represented by formula (C II) is illustrated for Y.

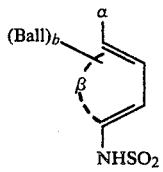

(CII)

wherein $\beta$ represents a non-metallic atomic group necessary for forming a benzene ring, which may be condensed with a carbon ring or a hetero ring, forming, for example, a naphthalene ring, a quinoline ring, a 5,6,7,8-tetrahydronaphthalene ring, or a chroman ring, etc.; $\alpha$ represents —$OG^{11}$ or —$NHG^{12}$, wherein $G^{11}$ represents a hydrogen atom or a group forming a hydroxyl group upon hydrolysis, and $G^{12}$ represents a hydrogen atom, an alkyl group having from 1 to 22 carbon atoms, or a hydrolyzable group; Ball represents a ballast group; and b represents an integer of 0, 1 or 2.

Specific examples of Y of the type illustrated by formula (C II) are described in Japanese Patent Application (OPI) Nos. 33826/73 and 50736/78.

Another example of Y which is effective for compounds of this type is a group represented by formula (C III)

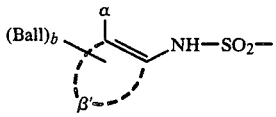

(CIII)

wherein

Ball, $\alpha$, and b each has the same meaning as defined for formula (C II); and $\beta'$ represents an atomic group forming a carbon ring, including a benzene ring. The benzene ring may be condensed with a carbon ring or a hetero ring, thereby forming, for example, a naphthalene ring, a quinoline ring, a 5,6,7,8-tetrahydronaphthalene ring, or a chroman ring.

Specific examples of Y of the type illustrated by formula (C III) are described in Japanese Patent Application (OPI) Nos. 113624/76, 12642/81, 16130/81, 16131/81, 4043/82 and 650/82 and U.S. Pat. No. 4,053,312.

A further example of Y which is effective for compounds of this type is a group represented by formula (C IV)

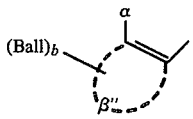

(CIV)

wherein Ball, $\alpha$, and b each has the same meaning as defined for formula (C II); and $\beta''$ represents an atomic group forming a heterocyclic ring such as a pyrazole ring or a pyridine ring, which may be condensed with a carbocyclic ring or a heterocyclic ring.

Specific examples of Y of the type illustrated by formula (C IV) are described in Japanese Patent Application (OPI) No. 104343/76.

A still further example of Y which is effective for compounds of this type is a group represented by formula (C V)

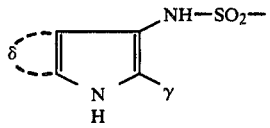

(CV)

wherein $\gamma$ represents preferably a hydrogen atom, a substituted or unsubstituted alkyl group, a substituted or unsubstituted aryl group, a substituted or unsubstituted heterocyclic group, or —CO—$G^{21}$, wherein $G^{21}$ represents —$OG^{22}$, —S—$G^{22}$, or

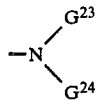

wherein $G^{22}$ represents a hydrogen atom, an alkyl group, a cycloalkyl group or an aryl group, $G^{23}$ has the same meaning as defined for $G^{22}$ or represents an acyl group derived from an aliphatic or aromatic carboxylic acid or sulfonic acid, and $G^{24}$ represents a hydrogen atom or a substituted or unsubstituted alkyl group; and $\delta$ represents an atomic group completing a condensed benzene ring.

Specific examples of Y of the type illustrated by formula (C V) are described in Japanese Patent Application (OPI) Nos. 104343/76, 46730/78, 130122/79 and 85055/82.

A still further example of Y which is effective from compounds of this type is a group represented by formula (C VI)

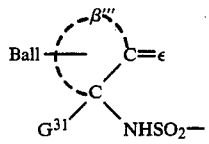

(CVI)

wherein Ball has the same meaning as defined for formula (C II); and $\epsilon$ represents an oxygen atom or =$NG^{32}$ wherein $G^{32}$ represents a hydroxyl group or an unsubstituted or substituted amino group. The compounds of formula $H_2N$—$G^{32}$ include hydroxylamine, hydrazines, semicarbazides, and thiosemicarbazides, etc. $\beta'''$ represents a 5-membered, 6-membered or 7-membered saturated or unsaturated nonaromatic hydrocarbon ring. $G^{31}$ represents a hydrogen atom or a halogen atom, for example, a fluorine atom, a chlorine atom, or a bromine atom.

Specific examples of Y illustrated by formula (C VI) are described in Japanese Patent Application (OPI) Nos. 3819/78 and 48534/79.

Other examples of Y for the compound of this type are described in, for example, Japanese Patent Publication Nos. 32129/73 and 39165/73, Japanese Patent Application (OPI) No. 64436/74, and U.S. Pat. No. 3,443,934, etc.

A still further example of Y which is effective for compounds of this type is a group represented by formula (C VII)

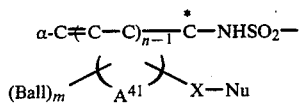

(CVII)

wherein $\alpha$ represents $OR^{41}$ or $NHR^{42}$, wherein $R^{41}$ represents a hydrogen atom or a hydrolyzable group, and $R^{42}$ represents a hydrogen atom or an alkyl group having from 1 to 50 carbon atoms; $A^{41}$ represents an atomic group necessary for forming an aromatic ring; Ball represents an organic immobilizing group present in the aromatic ring; m represents an integer of 1 or 2, and when m represents 2, Ball's may be the same or different; X represents a divalent organic group having from 1 to 8 atoms which forms a 5- to 12-membered ring in combination with an electrophilic center carbon atom, indicated by *, by oxidation with a nucleophilic group (Nu); Nu represents a nucleophilic group; and n represents an integer of 1 or 2. $\alpha$ may have the same meaning as defined for (C II).

Specific examples of Y illustrated by formula (C VII) are described in Japanese Patent Application (OPI) No. 20735/82.

Another type of compound represented by formula (C I) is a nondiffusible image forming compound which undergoes self-ring closing in the presence of a base, thereby releasing a diffusible dye, but does not substantially cause dye release by reacting with an oxidized product of a developing agent.

An example of Y which is effective for compounds of this type is a group represented by formula (C VIII)

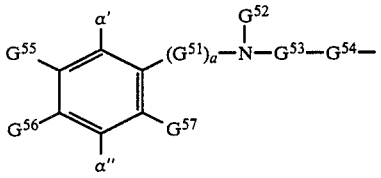

(CVIII)

wherein $\alpha'$ represents an oxidizable nucleophilic group, such as a hydroxyl group, a primary or secondary amino group, a hydroxyamino group, or a sulfonamido group, or a precursor thereof; $\alpha''$ represents a dialkylamino group or any one of the groups defined for $\alpha'$; $G^{51}$ represents an alkylene group having 1 to 3 carbon atoms; a represents an integer of 0 or 1; $G^{52}$ represents a substituted or unsubstituted alkyl group having 1 to 40 carbon atoms or a substituted or unsubstituted aryl group having 6 to 40 carbon atoms; $G^{53}$ represents an electrophilic group, such as —CO— or —CS—, etc.; $G^{54}$ represents an oxygen atom, a sulfur atom, a selenium atom, or a nitrogen atom. When it is a nitrogen atom, it may be substituted with a hydrogen atom, an alkyl or substituted alkyl group having from 1 to 10 carbon atoms, or an aromatic residue having from 6 to 20 carbon atoms; $G^{55}$, $R^{56}$ and $G^{57}$ each represents a hydrogen atom, a halogen atom, a carbonyl group, a sulfamoyl group, a sulfonamido group, an alkyloxy group having 1 to 40 carbon atoms or the same group as defined for $G^{52}$, or $G^{55}$ and $G^{56}$, when taken together, may form a 5- to 7-membered ring; or $G^{56}$ may be a group of the formula

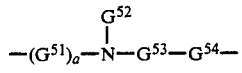

wherein $G^{51}$, a, $G^{52}$, $G^{53}$ and $G^{54}$ are as defined above, and at least one of $G^{52}$, $G^{55}$, $G^{56}$ and $G^{57}$ represents a ballast group. Examples of Y of this type is disclosed in Japanese Patent Application (OPI) No. 63618/76.

Other examples of Y which are effective for compounds of this type are groups represented by formulae (C IX) and (C X)

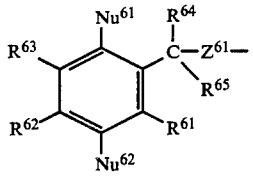

(CIX)

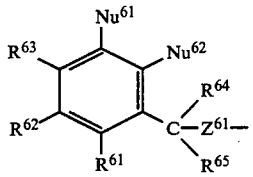

(CX)

wherein $Nu^{61}$ and $Nu^{62}$ (which may be the same or different) each represents a nucleophilic group or a precursor thereof; $Z^{61}$ represents a divalent atomic group which is electrically negative with respect to the carbon atom at which $R^{64}$ and $R^{65}$ are substituted; $R^{61}$, $R^{62}$ and $R^{63}$, which may be the same or different, each represents a hydrogen atom, a halogen atom, an alkyl group, an alkoxyl group, or an acylamino group, $R^{61}$ and $R^{62}$, when adjacent on the ring, may form a condensed ring, and $R^{62}$ and $R^{63}$, when adjacent on the ring, may form a condensed ring; $R^{64}$ and $R^{65}$, which may be the same or different, each represents a hydrogen atom, a hydrocarbon group, or a substituted hydrocarbon group; and a sufficiently large ballast group, Ball, to make the compound immobile is present in at least one of $R^{61}$, $R^{62}$, $R^{63}$, $R^{64}$ and $R^{65}$.

Specific examples of Y illustrated by formulae (C IX) and (C X) are described in Japanese Patent Application (OPI) Nos. 69033/78 and 130927/79.

A further example of Y for compounds of this type is a group represented by formula (C XI)

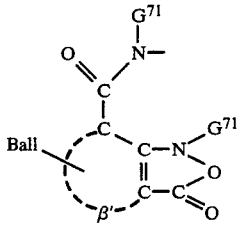

(CXI)

wherein Ball and $\beta'$ each has the same meaning as defined for formula (C III); and $G^{71}$ represents an alkyl group (including a substituted alkyl group).

Specific examples of Y illustrated by formula (C XI) are described in Japanese Patent Application (OPI) Nos. 111628/74 and 4819/77.

A still another type of compound represented by formula (C I) is a nondiffusible image forming compound which does not release a dye by itself, but releases a dye on reacting with a reducing agent. In this case, it is preferred to use in combination an "electron donor" compund facilitating the redox reaction.

An example of Y which is effective for compounds of this type is a group represented by formula (C XII)

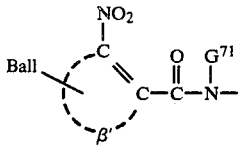

(CXII)

wherein Ball and $\beta'$ each has the same meaning as defined for formula (C III); and $G^{71}$ represents an alkyl group (including a substituted alkyl group).

Specific examples of Y illustrated by formula (C XII) are described in Japanese Patent Application (OPI) Nos. 35533/78 and 110827/78.

Another example of Y which is effective for compounds of this type is a group represented by formula (C XIII)

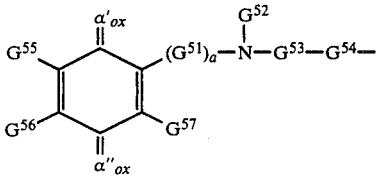

(CXIII)

wherein $\alpha'_{ox}$ and $\alpha''_{ox}$ each represents a group releasing $\alpha'$ or $\alpha''$ upon reduction and $\alpha'$, $\alpha''$, $G^{51}$, $G^{52}$, $G^{53}$, $G^{54}$, $G^{55}$, $G^{56}$, $G^{57}$ and a each has the same meaning as defined for formula (C VIII).

Specific examples of Y illustrated by formula (C XIII) are described in Japanese Patent Application (OPI) No. 110827/78 and U.S. Pat. Nos. 4,356,249 and 4,358,525.

Further examples of Y which are effective for compounds of this type are groups represented by formulae (C XIVA) and (C XIVB)

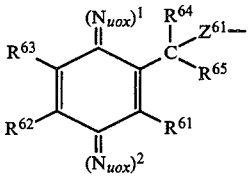

(CXIVA)

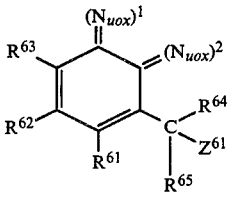

(CXIVB)

wherein $(Nuox)^1$ and $(Nuox)^2$, which may be the same or different, each represents an oxidized nucleophilic group; and $R^{61}$, $R^{62}$, $R^{63}$, $R^{64}$, $R^{65}$, and $Z^{61}$ each has the same meaning as defined for formulae (C IX) and (C X).

Specific examples of Y illustrated by formulae (C XIVA) and (C XIVB) are described in Japanese Patent Application (OPI) Nos. 130927/79 and 164342/81.

In the reference cited in connection with formulae (C XII), (C XIII), (C XIVA) and (C XIVB), such describe electron donors to be used in combination with these compounds.

A still another type of compound represented by formula (C I) is a linked donor acceptor compound (an LDA compound). This compound is a nondiffusible image forming compound which releases a diffusible dye by a donor acceptor reaction in the presence of a base, but does not substantially cause dye formation by reacting with an oxidized product of a developing agent.

An example of Y which is effective for compounds of this type is a group represented by formula (C XV)

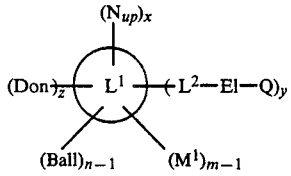

(CXV)

wherein n, x, y and z each represents 1 or 2; m represents an integer of 1 or more; Don represents a group containing an electron donor or a precursor moiety thereof; $L^1$ represents an organic group connecting Nup to —El—Q or Don; Nup represents a precursor of a nucleophilic group; El represents an electrophilic center; Q represents a divalent group; Ball represents a ballast group; $L^2$ represents a connecting group; and $M^1$ represents an appropriate substituent.

Specific examples of Y illustrated by formula (C XV) are described in Japanese Patent Application (OPI) No. 185333/84.

The ballast group is an organic ballast group capable of making dye image forming compounds nondiffusible, and is preferably a group containing a hydrophobic group having from 8 to 32 carbon atoms. These organic ballast groups are linked to the dye image forming compounds, directly or through a connecting group, such as an imino bond, an ether bond, a thioether bond, a carbonamido bond, a sulfonamido bond, a ureido bond, an ester bond, an imido bond, a carbamoyl bond, and a sulfamoyl bond. These connecting groups may be used singly or in combination with each other.

Two or more kinds of the dye providing substances can be employed together. In such a case two or more kinds of dye providing substances may be used together in order to represent the same hue or in order to reproduce black color.

Specific examples of dye forming materials for use in this invention are described in the abovedescribed patents and patent applications. In this invention, they are partially illustrated below.

For example, examples of the dye providing materials shown by the foregoing formula (C I) are as follows.

-continued
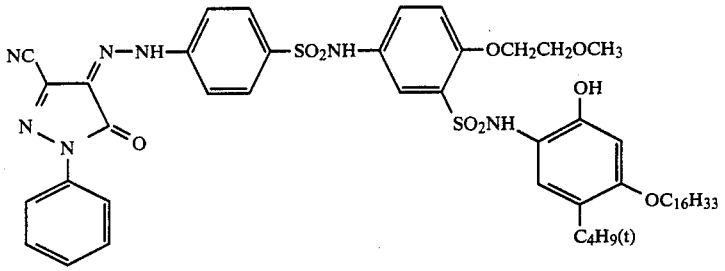
Dye-Providing Material (2)
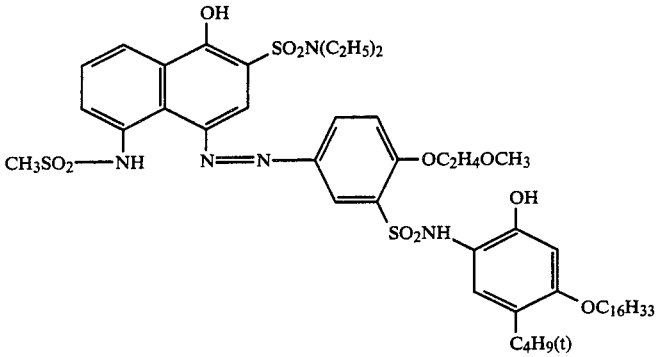
Dye-Providing Material (3)
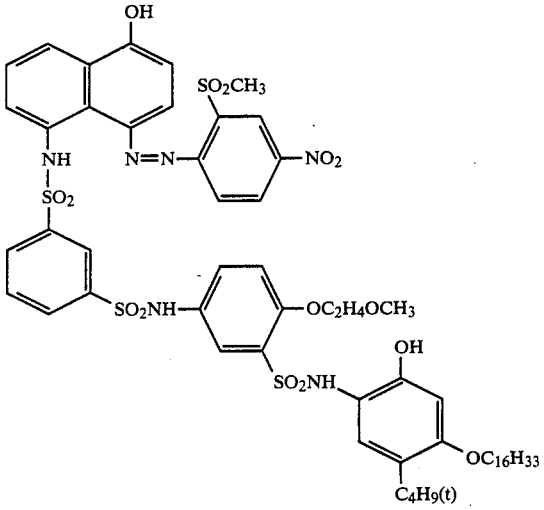
Dye-Providing Material (4)
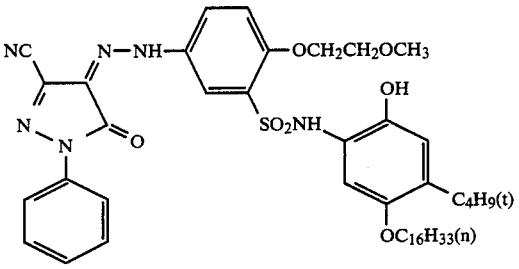
Dye-Providing Material (5)
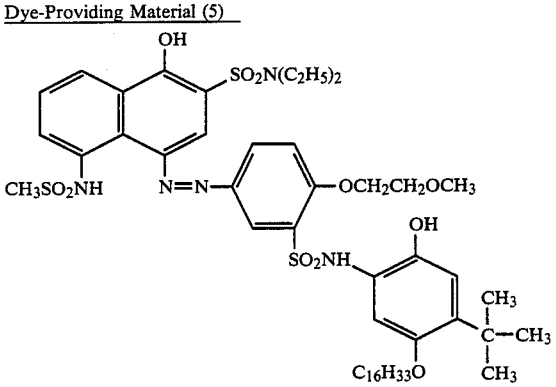
Dye-Providing Material (6)
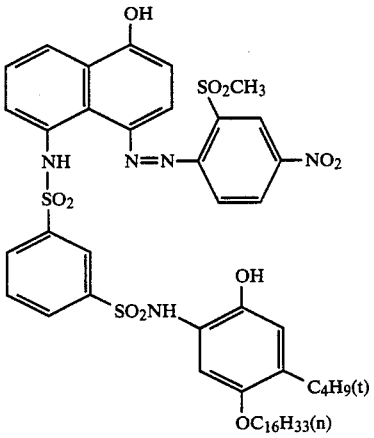

-continued
Dye-Providing Material (7)
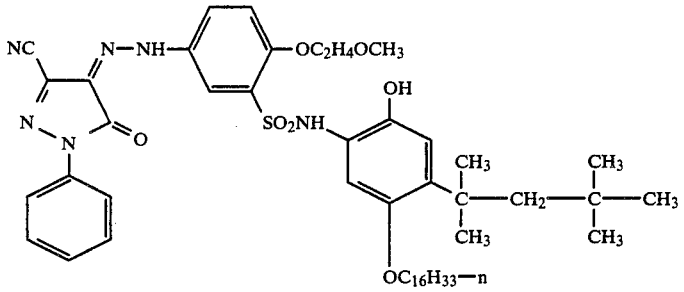
Dye-Providing Material (8)
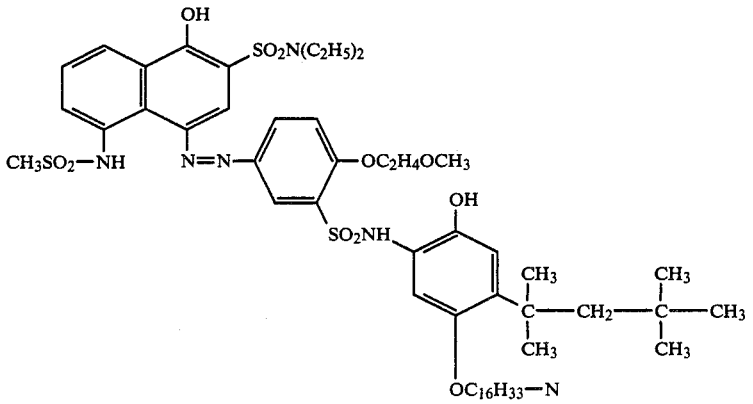
Dye-Providing Material (9)
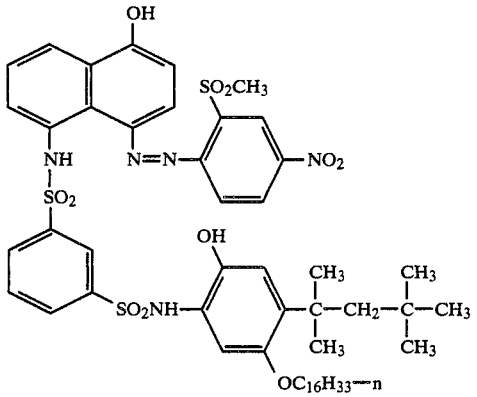
Dye-Providing Material (10)
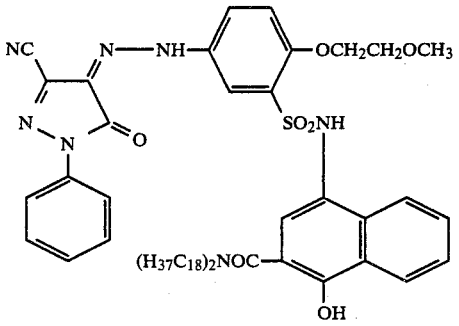
Dye-Providing Material (11)
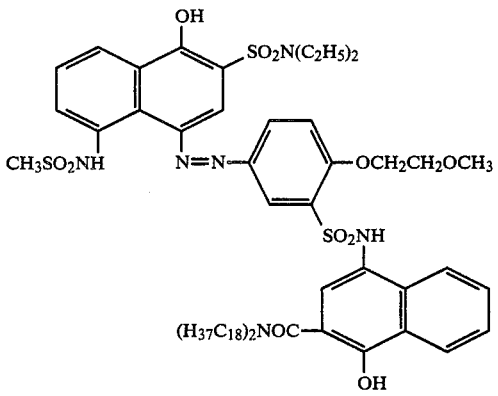
Dye-Providing Material (12)
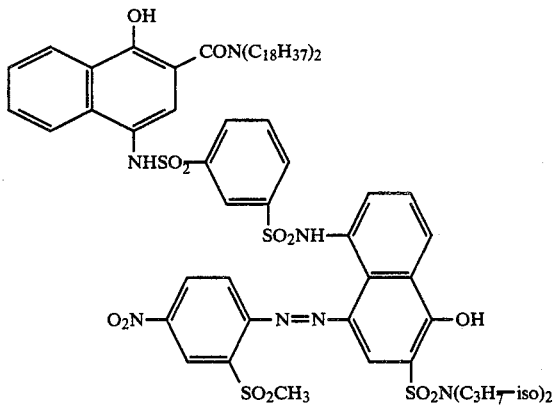
Dye-Providing Material (13)

-continued

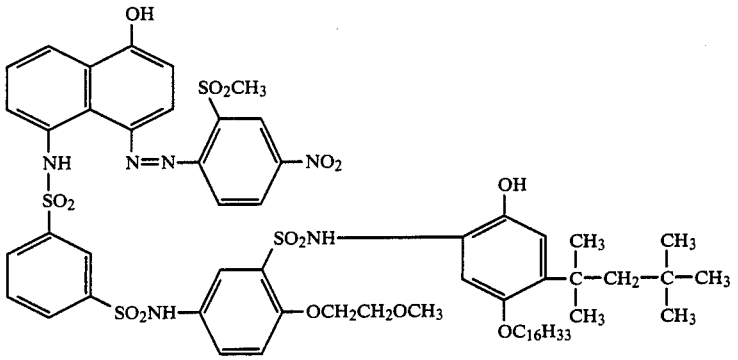

Dye-Providing Material (14)

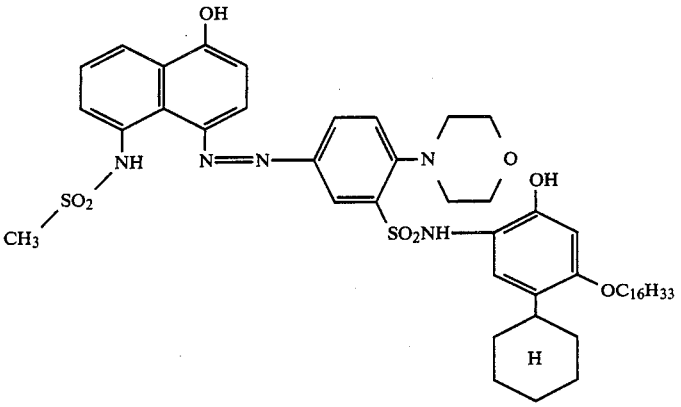

Dye-Providing Material (15)

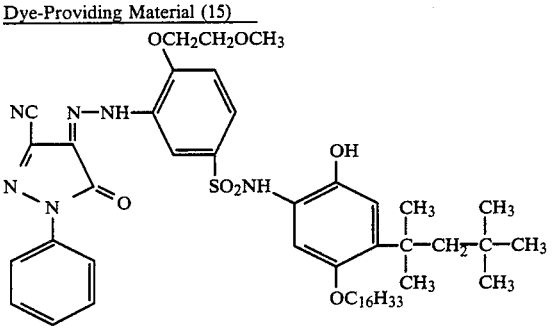

Dye-Providing Material (16)

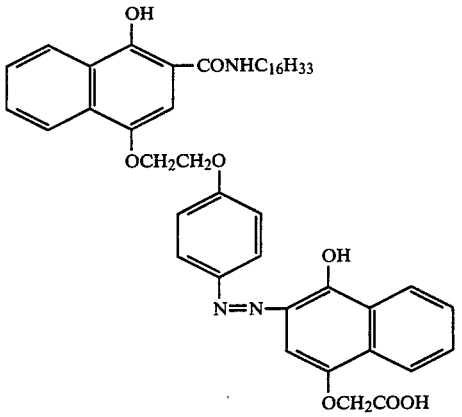

The dye providing substances are preferably employed in a range from 10 mg/m$^2$ to 15 g/m$^2$, and more preferably in a range from 20 mg/m$^2$ to 10 g/m$^2$ (in total).

The various materials described above are for forming an imagewise distribution of mobile dye or dyes corresponding to a light exposure in a light-sensitive material by heat development, and a process of transferring the dye images into a dye fixing material (so-called diffusion transfer) for visualizing the dye images is described in the patents or patent applications cited above as well as in Japanese Patent Application (OPI) Nos. 168439/84 and 182447/84.

In this invention, the dye providing materials can be introduced into a layer of a light-sensitive material by a known process as described, e.g., in U.S. Pat. No. 2,322,027. In this case, a high boiling organic solvent and/or a low boiling organic solvent as described below can be used.

That is, the dye providing material is dissolved in a high boiling organic solvent such as, for example, a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethyllaurylamide, etc.), a fatty acid ester (e.g., dibutoxyethyl succinate, dioctyl azerate, etc.), a trimesic acid ester (e.g., tributyl trimesate, etc.), etc., or a low boiling organic acid having a boiling point of about 30° C. to 160° C., such as a lower alkyl acetate (e.g., ethyl acetate, butyl acetate, etc.), ethyl propionate, secondary butyl alcohol, methyl isobutyl ketone, β-ethoxyethyl acetate, methyl cellosolve acetate, cyclohexanone, etc., and then dispersed in a hydrophilic colloid as a solution. In this case, a mixture of the aforesaid high boiling organic solvent and low boiling organic solvent may be used for dissolving the dye providing material.

Also, a dispersing method using a polymer described in Japanese Patent Publication No. 39853/76 and Japanese Patent Application (OPI) No. 59943/76 can be used. Also, in the case of dispersing the dye providing material in a hydrophilic colloid, various surface active agents may be used.

The amount of the high boiling organic solvent which is used in this invention is less than 10 g, preferably less than 5 g, per 1 g of the dye providing material to be used.

Examples of reducing agents for use in this invention include the following compounds.

That is, examples include hydroquinone compounds (e.g., hydroquinone, 2,5-dichlorohydroquinone, 2-chlorohydroquinone, etc.), aminophenol compounds (e.g., 4-aminophenol, N-methylaminophenol, 3-methyl-4-aminophenol, 3,5-dibromoaminophenol, etc.), catechol compounds (e.g., catechol, 4-cyclohexylcatechol, 3-methoxycatechol, 4-(N-octadecyl)catechol, etc.), phenylenediamine compounds (e.g., N,N-diethyl-p-phenylenediamine, 3-methyl-N,N-diethyl-p-phenylenediamine, 3-methoxy-N-ethyl-N-ethoxy-p-phenylenediamine, N,N,N', N'-tetramethyl-p-phenylenediamine, etc.).

Examples of more preferred reducing agent are 3-pyrazolidone compounds (e.g., 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone, etc.

A combination of various developing agents, as disclosed in U.S. Pat. No. 3,039,869, can also be used.

The addition amount of the reducing agent for use in this invention is generally from 0.01 to 20 mols, and preferably from 0.1 to 10 mols, per mol of silver.

In the case of using a reducing dye providing material, a so-called auxiliary developing agent can be used, if desired, in this invention. The auxiliary developing agent for use in this case is a material which is oxidized by silver halide to form the oxidation product having a capability of oxidizing the reducing base material in the dye providing material.

Examples of the useful auxiliary developing agents include hydroquinone, alkyl-substituted hydroquinones such as t-butylhydroquinone, 2,5-dimethylhydroquinone, etc., catechols, pyrogallols, halogen-substituted hydroquinones such as chlorohydroquinone, dichlorohydroquinone, etc., alkoxy-substituted hydroquinones such as methoxyhydroquinone, etc., polyhydroxybenzene derivatives such as methylhydroxynaphthalene, etc. Other examples of the useful auxiliary developing agent are methyl gallate, ascorbic acid, ascorbic acid derivatives, hydroxylamines such as N,N'-di(2-ethoxyethyl)hydroxylamine, etc., pyrazolidones such as 1-phenyl-3-pyrazolidone, 4-methyl-4-hydroxymethyl-1-phenyl-3-pyrazolidone, etc., reductones, hydroxytetronic acids, etc.

The auxiliary developing agent can be used in a suitable concentration range. A useful concentration range is from 0.0005 to 20 times, and preferably from 0.001 to 4 times, the molar amount of silver.

Silver halides that can be used in this invention include silver chloride, silver chlorobromide, silver chloroiodide, silver bromide, silver iodobromide, silver chloroiodobromide, silver iodide, etc.

For example, silver iodobromide may be prepared by adding an aqueous silver nitrate solution to an aqueous potassium bromide solution to first form silver bromide grains, and then adding thereto potassium iodide.

The silver halide for use in this invention may be a mixture of two or more silver halides having different size and/or different silver halide composition.

The size of the silver halide grains for use in this invention are preferably from 0.001 μm to 10 μm, and more preferably from 0.001 μm to 5 μm, in mean grain size.

The silver halide for use in this invention may be used as is (i.e., without treatment after formation) but may be chemically sensitized by using a chemical sensitizer such as a compound of sulfur, selenium, tellurium, etc., or a compound of gold, platinum, palladium, rhodium, iridium, etc.; a reducing agent such as tin halides, etc.; or a combination thereof. Such chemical sensitization is described in T. H. James, *The Theory of the Photographic Process,* 4th Ed., Chapter 5, pages 149–169, Macmillan, 1977.

The coating amount of the light-sensitive silver halide is properly from 1 mg/m$^2$ to 10 g/m$^2$, as silver, in this invention.

In a particularly preferred embodiment of this invention, an organic silver salt exists together with the aforesaid components in this invention. The organic silver salt functions to form a silver image by reacting with the above-described dye forming material or a reducing agent existing, if desired, with the dye forming material when heated to a temperature higher than 80° C., and preferably higher than 100° C., in the presence of light-exposed silver halide. By using the organic silver salt oxidizing agent together with the above-described components, a light-sensitive material capable of color forming with high density can be obtained.

Examples of the organic silver salt oxidizing agent are described in Japanese Patent Application (OPI) No. 58543/83 and, for example, there are as follows.

There are, first, silver salts of organic compounds having a carboxy group and typical examples thereof are silver salts of aliphatic carboxylic acids and silver salts of aromatic carboxylic acids.

Other examples are silver salts of compounds having a mercapto group or a thione group, or derivatives of such compounds.

Still other examples are silver salts of compounds having an imino group. For example, there are the silver salts of benzotriazole and the derivatives thereof described in Japanese Patent Publication Nos. 30270/69 and 18416/70; silver salts of alkyl-substituted benzotriazoles, such as a silver salt of methylbenzotriazole; silver salts of halogen-substituted benzotriazoles such as a silver salt of 5-chlorobenzotriazole; silver salts of carboimidobenzotriazoles, such as a silver salt of butylcarboimidobenzotriazole; the silver salts of 1,2,4-triazole and 1-H-tetrazole described in U.S. Pat. No. 4,220,709;

a silver salt of carbazole, a silver salt of saccharin, a silver salt of imidazole and imidazole derivatives.

Also, the silver salts described in *Research Disclosure,* No. 170, 17029 (June, 1978) and organic metal salts such as copper stearate can be used as the organic metal salt oxidizing agent in this invention.

The preparation methods of these silver halides and organic silver salts and the method of mixing them are described in *Research Disclosure,* No. 170, 17029 (June, 1978), Japanese Patent Application (OPI) Nos. 32928/75, 42529/76, 13224/74 and 17216/75, and U.S. Pat. No. 3,700,458.

The coating amounts of the light-sensitive silver halide and the organic silver salt are properly 50 mg/m$^2$ to 10 g/m$^2$ as silver.

As the binder for use in this invention, hydrophilic binders can be used solely or as a combination thereof.

As the hydrophilic binder, a transparent or translucent hydrophilic binder can be typically used and examples of the binder are gelatin, gelatin derivatives, cellulose derivatives, starch derivatives, gum arabic, etc., as well as synthetic hydrophilic polymers such as water-soluble polyvinyl compounds (e.g., polyvinylpyrrolidone, acrylamide polymers, etc.). Another synthetic polymer that can be used is a latex form dispersed vinyl compound, used for improving the dimensional stability of the light-sensitive material.

Also in this invention, a compound capable of stabilizing images formed simultaneously with the activating development can be used. Examples of such a compound are isothiuroniums such as 2-hydroxyethylisothiuronium trichloroacetate as described in U.S. Pat. No. 3,301,678; bis(isothiuronium) such as 1,8-(3,6-dioxaoctane)bis(isothiuronium) trichloroacetate) as described in U.S. Pat. No. 3,669,670; thiol compounds as described in West German Patent Application (OLS) No. 2,162,714; thiazolium compounds such as 2-amino-2-thiazolium trichloroacetate, 2-amino-5-bromoethyl-2-thiazolium trichloroacetate, etc., as described in U.S. Pat. No. 4,012,260; compounds having $\alpha$-sulfonyl acetate as the acid moiety such as bis(2-amino-2-thiazolium)methylenebis(sulfonyl acetate), 2-amino-2-thiazoliumphenyl sulfonyl acetate, etc., as described in U.S. Pat. No. 4,060,420; and compounds having 2-carboxycarboxyamide as the acid moiety as described in U.S. Pat. No. 4,088,496.

Furthermore, the azole thioether compounds and blocked azolinthione compounds as described in Belgian Pat. No. 768,071, the 4-aryl-1-carbamyl-2-tetrazolin-5-thione compounds as described in U.S. Pat. No. 3,893,859, and other compounds as described in U.S. Pat. Nos. 3,839,041, 3,844,788, and 3,877,940 can be preferably used in this invention.

The above-described various components for constituting the heat developable light-sensitive material of this invention can be disposed at desired proper positions. For example, if desired, one or more of the components may be disposed in one or more layers of the light-sensitive material. In some cases, it is preferred that the reducing agent, the image stabilizer and/or a specific amount (proportion) of other additives are incorporated in a protective layer of the light-sensitive material. In such a case, the transfer of the additives between layers of the heat developable light-sensitive material can be advantageously reduced.

The heat developable light-sensitive material of this invention can be effectively used for forming negative images or positive images. In this case, the formation of negative images or positive images mainly depends upon the selection of the specific light-sensitive silver halide. For example, for forming direct positive images, the internal image forming silver halide emulsions described in U.S. Pat. Nos. 2,592,250, 3,206,313, 3,367,778 and 3,447,927 can be used and also a mixture of the surface image forming silver halide emulsion and the internal image forming silver halide emulsion described in U.S. Pat. No. 2,996,382 can be used.

In this invention, various exposure means can be used. Latent images can be formed by imagewise exposure of radiation including visible light. In general, light sources usually used for color print, such as a tungsten lamp, a mercury lamp, a halogen lamp such as an iodine lamp, etc., a xenon lamp, laser light, a CRT light source, a fluorescent lamp, a light emitting diode, etc., can be used.

In this invention, the development is performed by applying heat to the heat developable light-sensitive material of this invention and the heating means may be a heating element or a similar material to it, such as a hot plate, a hot iron, a heating roller, a heating element using a conductive material such as carbon or titanium white.

The silver halide for use in this invention may be spectrally sensitized by methine dyes and the like. Examples of the dyes for use in this case are cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine dyes, merocyanine dyes, and complex merocyanine dyes. For these dyes, nuclei usually utilized for cyanine dyes as basic heterocyclic nuclei can be applied. Examples of these nuclei are pyrroline nuclei, oxazoline nuclei, thiazolium nuclei, pyrrole nuclei, oxazole nuclei, thiazole nuclei, selenazole nuclei, imidazole nuclei, tetrazole nuclei, pyridine nuclei, etc., the nuclei formed by fusing alicyclic hydrocarbon rings to the aforesaid nuclei, and the nuclei formed by fusing aromatic hydrocarbon rings to the foregoing nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. The carbon atoms of these nuclei may also be substituted.

For the merocyanine dyes or complex merocyanine dyes, 5- or 6-membered heterocyclic nuclei such as pyrazolin-5-one nuclei, thiohydantoin nuclei, 2-thiooxazolidine-2,4-dione nuclei, thiazoline-2,4-dione nuclei, rhodanine nuclei, thiobarbituric acid nuclei, etc., can be applied as nuclei having a ketomethylene structure.

These sensitizing dyes may be used individually or as a combination thereof and combinations of sensitizing dyes is frequently useful for supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Pat. Nos. 1,344,281, 1,507,803, Japanese Patent Publication Nos. 4936/68, 12375/78, and Japanese Patent Application (OPI) Nos. 110618/77 and 109925/77.

Also, the silver halide emulsion for use in this invention may contain a dye having no spectral sensitizing action by itself, or a material which does not substantially absorb visible light but which shows a supersensitization action together with the sensitizing dye or dyes.

Examples of such a dye or compound are aminostyryl compounds substituted by a nitrogen-containing heterocyclic group as described, for example, in U.S. Pat. Nos. 2,933,390 and 3,635,721; aromatic organic acid-formaldehyde condensation products as described, for example, in U.S. Pat. No. 3,743,510, cadmium salts, azaindene compounds. The combinations of compounds described in U.S. Pat. Nos. 3,615,613, 3,615,641, 3,617,295, and 3,635,721 can be advantageously used in this invention.

The supports for the heat developable light-sensitive materials of this invention and the dye fixing materials are those capable of being subjected to the desired processing temperature. In general, as the supports, glass plates, papers, metal foils, as well as acetyl cellulose films, cellulose ester films, polyvinyl acetal films, polystyrene fulms, polycarbonate films, polyethylene terephthalate films, and other similar films or resin materials are used. Also, paper support laminated with a polymer such as polyethylene, etc., can be used. The polyesters described in U.S. Pat. Nos. 3,634,089 and 3,725,070 are preferably used in this invention as the supports.

The heat developable light-sensitive material of this invention and the dye fixing material may further contain an inorganic or organic hardening agent in the emulsion layer or other binder layer. Examples of the hardening agent are chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc. They can be used solely or as a combination thereof.

For the transfer of dyes from the light-sensitive layer to a dye fixing layer, a dye transfer assistant can be used.

In a system of supplying the dye transfer assistant from outside, water or an aqueous basic solution containing an inorganic alkali metal salt such as sodium hydroxide, potassium hydroxide, etc., can be used. Also, a low boiling solvent such as methanol, N,N-dimethylformamide, acetone, diisobutyl ketone, etc., or a mixture of the low boiling solvent and water or an aqueous base solution can be used as the dye transfer assistant. The dye transfer assistant may be used as a manner of wetting the image receiving layer with the assistant.

When the dye transfer assistant is incorporated in the light-sensitive material or the dye fixing material, it is unnecessary to supply the dye transfer assistant from outside. The dye transfer assistant may be incorporated in the light-sensitive material or the dye fixing material in the form of crystal water or microcapsules or may be incorporated therein as a precursor capable of releasing a solvent at high temperature. A system of incorporating a hydrophilic heat solvent which is in a solid state at normal room temperature (about 20° C.) and becomes a liquid state at high temperature in the light-sensitive material or the dye fixing material is more preferred. The hydrophilic heat solvent may be incorporated in the light-sensitive material and/or the dye fixing material. Also, the layer containing the hydrophilic heat solvent may be an emulsion layer, an interlayer, a protective layer or a dye fixing layer, but it is preferred to incorporate the solvent in the dye fixing layer and/or a layer adjacent to the layer.

Examples of the hydrophilic heat solvent are ureas, pyridines, amides, sulfonamides, imides, alcohols, oximes, and other heterocyclic rings.

Furthermore, sulfamide derivatives, cationic compounds having a pyridinium group, etc., surface active agents having a polyethylene oxide chain, sensitizing dyes, halation preventing dyes, irradiation preventing dyes, hardening agents, mordants, etc., described in European Pat. Nos. 76,492 and 66,282, West German Pat. No. 3,315,485, Japanese Patent Application (OPI) Nos. 154445/84 and 152440/84 can be also used in the heat developable light-sensitive materials of this invention.

Also, the exposure methods described in the aforesaid patents can be employed in this invention.

The following examples are intended to illustrate the present invention, but are not to be considered as limiting the invention in any way.

EXAMPLE 1

A silver iodobromide emulsion was prepared as follows.

In 3,000 ml of water were dissolved 40 g of gelatin and 26 g of potassium bromide, and the solution was stirred at 50° C.

Then, a solution of 34 g of silver nitrate dissolved in 200 ml of water was added to the aforesaid solution over a period of 10 minutes and thereafter, a solution of 3.3 g of potassium iodide dissolved in 100 ml of water was added to the mixture over a period of 2 minutes.

The pH of the silver iodobromide emulsion thus formed was adjusted to precipitate excessive salts, which were removed. Then, the pH thereof was adjusted to 6.0 to provide a silver iodobromide emulsion at an amount of 400 g.

Then, a benzotriazole silver salt emulsion was prepared as follows.

In 3,000 ml of water were dissolved 28 g of gelatin and 13.2 g of benzotriazole and the solution was stirred at 40° C. Then, a solution of 17 g of silver nitrate dissolved in 100 ml of water was added to the solution over a period of 2 minutes. The pH of the benzotriazole silver salt emulsion was adjusted to precipitate excessive salts, which were removed from the system, and thereafter, the pH thereof was adjusted to 6.0 to provide 400 g of a benzotriazole silver salt emulsion.

A gelatin dispersion of a dye providing material (same as the above-described image forming material) was prepared by the following manner.

In 30 ml of ethyl acetate were dissolved 5 g of Dye Providing Material (8), 0.5 g of succinic acid 2-ethylhexyl ester sodium sulfonate, and 5 g of tricresyl phosphate under heating to about 60° C. After mixing the solution with 100 g of an aqueous solution of 10% gelatin with stirring, the mixture was dispersed by means of a homogenizer for 10 minutes at 10,000 rpm. Thus, a dispersion of the dye providing material was prepared.

Then, a gelatin dispersion of the compound in this invention was prepared as follows.

To 100 g of an aqueous 1% gelatin solution was added 10 g of Compound (8) of this invention and the compound was pulverized for 10 minutes in a mill by means of 100 g of glass beads having a mean particle size of about 0.6 mm. Thereafter, by separating the glass beads by filtration, a gelatin dispersion of the compound of this invention was obtained.

Then, Light-Sensitive Materials A and B were prepared as follows.

| Light-Sensitive Material A: | | |
|---|---|---|
| (a) | Silver iodobromide emulsion | 20 g |
| (b) | Benzotriazole silver salt emulsion | 10 g |
| (c) | Dispersion of Dye Providing Material (8) | 33 g |
| (d) | 5% Aqueous solution of the compound shown below: 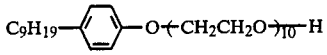 | 10 ml |
| (e) | 10% Aqueous solution of the compound shown below: $H_2NSO_2N(CH_3)_2$ | 4 ml |
| (f) | Solution of 1.6 g of basic precursor, guanidine trichloroacetate dissolved in 16 ml of ethanol | |
| (g) | Gelatin dispersion of Compound (8) of this invention | 10 ml |

Above components (a) to (g) were mixed under heating to dissolve the solid components and thereafter the solution was coated on a polyethylene terephthalate film of 180 μm thickness at a wet thickness of 33 μm followed by drying. Furthermore, a coating liquid having the following composition was coated thereon as a protective layer.

(i) 10% Aqueous gelatin solution: 30 ml (ii) Water: 70 ml

That is, the mixture of the above components (i) and (ii) was coated at a wet thickness of 30 μm as a protective layer and dried to provide Light-Sensitive Material A.

| Light-Sensitive Material B: | | |
|---|---|---|
| (a) | Silver iodobromide emulsion | 20 g |
| (b) | Benzotriazole silver salt emulsion | 10 g |
| (c) | Dispersion of Dye Providing Material (8) | 33 g |
| (d) | 5% Aqueous solution of the compound shown below: 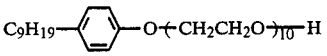 | 10 ml |
| (e) | 10% Aqueous solution of the compound shown below: $H_2NSO_2N(CH_3)_2$ | 4 ml |
| (f) | Solution of 1.6 g of basic precursor, guanidine trichloroacetate dissolved in 16 ml of ethanol | |
| (g) | Water | 10 ml |

Above components (a) to (g) were mixed under heating to dissolve the solid components and the solution was coated on a polyethylene terephthalate film of 180 μm thickness at a wet thickness of 33 μm and dried. Then, a protective layer was formed by the same manner as the case of preparing Light-Sensitive Material A to provide Light-Sensitive Material B.

Then, an image receiving material having an image receiving layer was prepared as follows.

In 200 ml of water was dissolved 10 g of poly(methyl acrylate-co-N,N,N-trimethyl-N-vinylbenzylammonium chloride) (methyl acrylate/vinylbenzylammonium chloride: 1/1) and the solution was uniformly mixed with 100 g of an aqueous solution of 10% limed gelatin. The mixture thus obtained was uniformly coated on a paper support laminated with polyethylene having dispersed therein titanium dioxide at a wet thickness of 90 μm and dried to provide an image receiving material.

Each of Light-Sensitive Materials A and B was imagewise exposed using a tungsten lamp for 10 seconds at 2,000 lux and then uniformly heated on a heat block heated to 140° C. for 30 seconds or 40 seconds.

After immersing the image receiving material in water, each of the light-sensitive materials thus heated was superposed on the image receiving material so that the coated layers of the materials were in a contact state.

Then, the assembly was heated on a heat block at 80° C. for 6 seconds and the image receiving material was peeled off from the light-sensitive material, whereby a negative magenta image was obtained on the image receiving material. The density of the negative image thus formed was measured using a Macbeth densitometer (RD-519) on each sample and the results are shown in Table 1.

TABLE 1

| | Heating for 30 Sec. at 140° C. | | Heating for 40 Sec. at 140° C. | |
|---|---|---|---|---|
| Sample | Maximum Density | Minimum Density | Maximum Density | Minimum Density |
| A* | 2.12 | 0.10 | 2.15 | 0.17 |
| B** | 2.15 | 0.15 | 2.20 | 0.32 |

*Sample of this invention

**Comparison sample

As is clear from the above results, when the developing time was extended for a further 10 seconds, the increase of both the maximum density and the minimum density is less by using the compound according to this invention. On the other hand, in the comparison sample containing no compound of this invention, the formation of fog increases greatly (i.e., great increase of minimum density). Accordingly, it can be seen that the compound of this invention has a high development stopping effect.

EXAMPLE 2

In this example, a benzotriazole silver salt emulsion was not used.

Light-Sensitive Materials C and D were prepared as described below.

| Light-Sensitive Material C: | | |
|---|---|---|
| (a) | Light-sensitive silver iodobromide emulsion (same as in Example 1) | 25 g |
| (b) | Dispersion of Dye Providing Material (same as in Example 1) | 33 g |
| (c) | 5% Aqueous solution of the compound shown below: 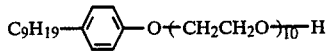 | 10 ml |
| (d) | 10% Aqueous solution of the compound shown below: $H_2NSO_2N(CH_3)_2$ | 4 ml |
| (e) | Solution of 1.5 g of guanidine trichloroacetate dissolved in 15 ml ethanol | |
| (f) | Gelatin dispersion of Compound (8) of the invention (same as in Example 1) | 10 ml |

Above components (a) to (f) were mixed and heated to dissolve the solid components and the solution was coated on a polyethylene terephthalate film of 180 μm thickness at a wet thickness of 33 μm and dried.

Furthermore, a coating liquid having the following composition was coated thereon to form a protective layer.

(i) 10% Aqueous gelatin solution: 30 ml (ii) Water: 70 ml

The mixture of the above components (i) and (ii) was coated on the light-sensitive layer thus formed at a wet thickness of 30 μm as a protective layer and dried to provide Light-Sensitive Material C.

| Light-Sensitive Material D: | | |
|---|---|---|
| (a) | Light-sensitive silver iodobromide emulsion (same as in Example 1) | 25 g |
| (b) | Dispersion of Dye Providing Material (same as in Example 1) | 33 g |
| (c) | 5% Aqueous solution of the compound shown below: 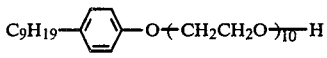 | 10 ml |
| (d) | 10% Aqueous solution of the compound shown below: $H_2NSO_2N(CH_3)_2$ | 4 ml |
| (e) | Solution of 1.5 g of guanidine trichloroacetate dissolved in 15 ml of ethanol | |
| (f) | Water | 10 ml |

Above components (a) to (f) were mixed under heating to dissolve solid components and then the solution was coated on a polyethylene terephthalate support of 180 μm thickness, at a wet thickness of 33 μm, and dried. Then, a protective layer was formed thereon as in Light-Sensitive Material C to provide Light-Sensitive Material D.

Processing Light-Sensitive Materials C and D as in Example 1, the results obtained are shown in Table 2.

TABLE 2

| | Heating for 30 Sec. at 140° C. | | Heating for 40 Sec. at 140° C. | |
|---|---|---|---|---|
| Sample | Maximum Density | Minimum Density | Maximum Density | Minimum Density |
| C* | 1.95 | 0.16 | 2.10 | 0.20 |
| D** | 2.00 | 0.20 | 2.18 | 0.37 |

*Sample of the invention
**Comparison sample

It can be seen that the compound of this invention has a high development stopping effect.

EXAMPLE 3

By following the same procedure as in Example 1 except that the compound shown in following Table 3 was used in place of Compound (8) of this invention in the coating liquid for Light-Sensitive Material A in Example 1, Samples E to L were prepared and the samples were processed in the same manner as in Example 1. The results are shown in Table 3.

TABLE 3

| | | Heating for 30 Sec. at 140° C. | | Heating for 40 Sec. at 140° C. | |
|---|---|---|---|---|---|
| Sample | Compound No. | Maximum Density | Minimum Density | Maximum Density | Minimum Density |
| E | (7) | 2.14 | 0.15 | 2.19 | 0.22 |
| F | (9) | 2.10 | 0.12 | 2.14 | 0.18 |
| G | (19) | 2.07 | 0.10 | 2.12 | 0.17 |
| H | (24) | 2.05 | 0.10 | 2.10 | 0.15 |
| I | (26) | 2.04 | 0.10 | 2.10 | 0.18 |
| J | (27) | 2.13 | 0.12 | 2.17 | 0.19 |
| K | (40) | 2.14 | 0.14 | 2.18 | 0.21 |
| L | (41) | 1.95 | 0.09 | 2.03 | 0.16 |
| B | None | 2.15 | 0.15 | 2.20 | 0.31 |

Samples E to L: Samples of this invention
Sample B: Comparison sample

From the above results, it can be seen that the compounds of this invention have excellent development stopping effect.

EXAMPLE 4

By following the same procedure as in Example 1 except that the following dye providing material was used in place of Dye Providing Material (8), Dispersions (I), (II), and (III) were prepared.

Dispersion (I) contained 5 g of Dye Providing Material (5).

Dispersion (II) contained 7.5 g of Dye Providing Material (7).

Dispersion (III) contained 5 g of Dye Providing Material (6).

Then, by following the same procedure as in the case of preparing Light-Sensitive Material A in Example 1 except that the above dispersion, Light-Sensitive Materials M, O, and Q were prepared, and by following the same procedure as the case of preparing Light-Sensitive Material B in Example 1 using the above dispersion, Light-Sensitive Materials N, P, and R were prepared. Each sample was provided in the same manner as in Example 1, and the results obtained are shown in Table 4.

TABLE 4

| | | | Heating for 30 Sec. at 140° C. | | Heating for 40 Sec. at 140° C. | |
|---|---|---|---|---|---|---|
| Sample | Dispersion of Dye Providing Material | Compound | Maximum Density | Minimum Density | Maximum Density | Minimum Density |
| M* | Dispersion (I) (magenta) | Added | 2.20 | 0.18 | 2.27 | 0.31 |
| N** | Dispersion (I) | None | 2.25 | 0.20 | 2.32 | 0.42 |
| O* | Dispersion (II) (yellow) | Added | 1.94 | 0.19 | 2.00 | 0.30 |
| P** | Dispersion (II) | None | 1.95 | 0.22 | 2.02 | 0.46 |
| Q* | Dispersion (III) (cyan) | Added | 2.26 | 0.20 | 2.32 | 0.27 |
| R** | Dispersion (III) | None | 2.30 | 0.20 | 2.34 | 0.38 |

*Samples of this invention
**Comparison samples

From the above results, it can be seen that the compounds of this invention have an excellent development stopping effect.

EXAMPLE 5

In this example, the following base precursor was used in place of the guanidine trichloroacetate in Example 1.

Base Precursor I:

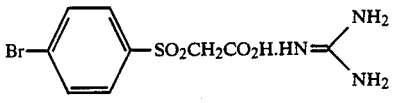

Base Precursor II:

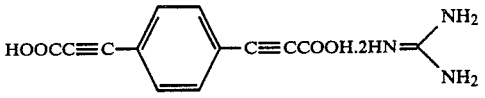

| Light-Sensitive Material S: | | |
|---|---|---|
| (a) | Silver iodobromide emulsion (same as in Example 1) | 20 g |
| (b) | Benzotriazole silver salt emulsion (same as in Example 1) | 10 g |
| (c) | Dispersion of Dye Providing Material (same as in Example 1) | 33 g |
| (d) | 5% Aqueous solution of the compound shown below: 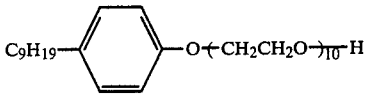 | 10 ml |
| (e) | 10% Aqueous solution of the compound shown below: $H_2NSO_2N(CH_3)_2$ | 4 ml |
| (f) | Water/methanol (1/1) solution of 8% Base Precursor I | 32 ml |
| (g) | Gelatin dispersion of Compound (8) of this invention (same as in Example 1) | 10 ml |

Above components (a) to (g) were mixed and heated to dissolve solid components and the solution was coated on a polyethylene terephthalate film of 180 μm thickness at a wet thickness of 38 μm and dried. Then, the following composition was coated thereon as a protective layer.

(i) 10% Aqueous gelatin solution 30 ml (ii) Water 70 ml

That is, the mixture of the above components (i) and (ii) was coated thereon at a wet thickness of 30 μm and dried to provide Light-Sensitive Material S.

| Light-Sensitive Material T: | | |
|---|---|---|
| (a) | Silver iodobromide emulsion (same as in Example 1) | 20 g |
| (b) | Benzotriazole silver salt emulsion (same as in Example 1) | 10 g |
| (c) | Dispersion of Dye Providing Material (same as in Example 1) | 33 g |
| (d) | 5% Aqueous solution of the compound shown below: | 10 ml |

-continued

Light-Sensitive Material T:

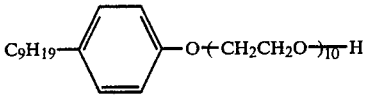

| | | |
|---|---|---|
| (e) | 10% Aqueous solution of the compound shown below: $H_2NSO_2N(CH_3)_2$ | 4 ml |
| (f) | Water/methanol (1/1) solution of 8% Base Precursor I | 32 ml |
| (g) | Water | 10 ml |

After mixing the above components (a) to (g) and heating to dissolve solid components, the solution was coated on a polyethylene terephthalate film of 180 μm thickness at a wet thickness of 38 μm and dried. Then, a protective layer was formed thereon in the same manner as in Light-Sensitive Material S.

| Light-Sensitive Material U: | | |
|---|---|---|
| (a) | Silver iodobromide emulsion (same as in Example 1) | 20 g |
| (b) | Benzotriazole silver salt emulsion (same as in Example 1) | 10 g |
| (c) | Dispersion of Dye Providing Material (same as in Example 1) | 33 g |
| (d) | 5% Aqueous solution of the compound shown below: 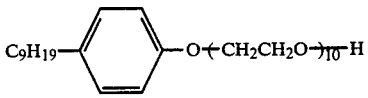 | 10 ml |
| (e) | 10% Aqueous solution of the compound shown below: $H_2NSO_2N(CH_3)_2$ | 4 ml |
| (f) | Water/methanol (1/1) solution of 8% Base Precursor II | 32 ml |
| (g) | Gelatin dispersion of Compound (8) of this invention (same as in Example 1) | 10 ml |

After mixing the above components (a) to (g) and heating to dissolve solid components, the solution was coated on a polyethylene terephthalate film of 180 μm thickness at a wet thickness of 38 μm and dried.

Furthermore, the following composition was coated thereon as a protective layer.

(i) 10% Aqueous gelatin solution: 30 ml (ii) Water: 70 ml

That is, the mixture of the above components (i) and (ii) was coated at a wet thickness of 30 μm and dried to provide Light-Sensitive Material U.

| Light-Sensitive Material V: | | |
|---|---|---|
| (a) | Silver iodobromide emulsion (same as in Example 1) | 20 g |
| (b) | Benzotriazole silver salt emulsion (same as in Example 1) | 10 g |
| (c) | Dispersion of Dye Providing Material (same as in Example 1) | 33 g |
| (d) | 5% Aqueous solution of the compound shown below: 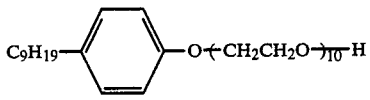 | 10 ml |
| (e) | 10% Aqueous solution of the compound | 4 ml |

-continued

| Light-Sensitive Material V: | | |
|---|---|---|
| | shown below: $H_2NSO_2N(CH_3)_2$ | |
| (f) | Water/methanol (1/1) solution of 8% Base Precursor II | 32 ml |
| (g) | Water | 10 ml |

After mixing the above components (a) to (g) and heating to dissolve solid components, the solution was coated on a polyethylene terephthalate film of 180 μm thickness at a wet thickness of 38 μm and dried. A protective layer was formed in the same manner as in the case of Light-Sensitive Material U to provide Light-Sensitive Material V.

Samples S, T, U and V prepared above were treated in the same manner as in Example 1, and the reuslts thus obtained are shown in Table 5.

TABLE 5

| Sample | Base Precursor | Compound (8) | Heating for 30 Sec. at 140° C. Maximum Density | Heating for 30 Sec. at 140° C. Minimum Density | Heating for 40 Sec. at 140° C. Maximum Density | Heating for 40 Sec. at 140° C. Minimum Density |
|---|---|---|---|---|---|---|
| S* | I | Added | 1.78 | 0.10 | 1.85 | 0.18 |
| T** | I | None | 1.80 | 0.12 | 1.92 | 0.29 |
| U* | II | Added | 2.12 | 0.11 | 2.19 | 0.20 |
| V** | II | None | 2.15 | 0.14 | 2.21 | 0.32 |

*Samples of this invention
**Comparison samples

From the above results, it can be seen that by using the compound of this invention, a high development stopping effect is obtained.

EXAMPLE 6

| Light-Sensitive Material W: | | |
|---|---|---|
| (a) | Silver iodobromide emulsion (same as in Example 1) | 20 g |
| (b) | Benzotriazole silver salt emulsion (same as in Example 1) | 10 g |
| (c) | Dispersion of Dye Providing Material (same as in Example 1) | 33 g |
| (d) | 5% Aqueous solution of the compound shown below: | 10 ml |
| | 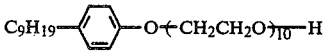 | |
| (e) | 10% Aqueous solution of the compound shown below: $H_2NSO_2N(CH_3)_2$ | 4 ml |
| (f) | Solution of 0.8 g of a base precursor, guanidine trichloroacetate dissolved in 8 ml of ethanol | |
| (g) | Gelatin dispersion of Compound (8) (same as in Example 1) | 5 ml |
| (h) | Water | 13 ml |

After mixing the above components (a) to (h) and heating to dissolve solid components, the solution was coated on a polyethylene terephthalate film of 180 μm thickness at a wet thickness of 33 μm and dried.

Furthermore, the following composition was coated thereon as a protective layer.

(i) 10% Aqueous gelatin solution: 30 ml
(ii) Water: 56 ml
(iii) Solution of 0.9 g of guanidine trichloroacetate dissolved in 9 ml of ethanol
(iv) Gelatin dispersion of Compound (8): 5 ml That is, a mixture of the above components (i) to (iv) was coated at a wet thickness of 30 μm and dried to provide Light-Sensitive Material X.

| Light-Sensitive Material X: | | |
|---|---|---|
| (a) | Silver iodobromide emulsion (same as in Example 1) | 20 g |
| (b) | Benzotriazole silver salt emulsion (same as in Example 1) | 10 g |
| (c) | Dispersion of Dye Providing Material (same as in Example 1) | 33 g |
| (d) | 5% Aqueous solution of the compound shown below: | 10 ml |
| | 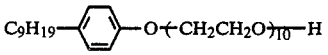 | |
| (e) | 10% Aqueous solution of the compound shown below: $H_2NSO_2N(CH_3)_2$ | 4 ml |
| (f) | Solution of 0.8 g of a base precursor, guanidine trichloroacetate dissolved in 8 ml of ethanol | |
| (g) | Water | 18 ml |

After mixing the above components (a) to (g) and heating to dissolve solid components, the solution was coated on a polyethylene terephthalate film of 180 μm thickness at a wet thickness of 33 μm and dried.

Furthermore, the following composition was coated thereon as a protective layer.

(i) 10% Aqueous gelatin solution: 30 ml
(ii) Water: 61 ml
(iii) Solution of 0.9 g of guanidine trichloroacetate in 9 ml of ethanol The mixture of the above components (i) to (iii) was coated at a wet thickness of 30 μm as a protective layer and dried to provide Light-Sensitive Material X.

Light-Sensitive Materials W and X thus prepared were treated as in Example 1 and the results obtained are shown in Table 6.

TABLE 6

| Sample | Heating for 30 Sec. at 140° C. Maximum Density | Heating for 30 Sec. at 140° C. Minimum Density | Heating for 40 Sec. at 140° C. Maximum Density | Heating for 40 Sec. at 140° C. Minimum Density |
|---|---|---|---|---|
| W* | 2.02 | 0.10 | 2.09 | 0.19 |
| X** | 2.10 | 0.12 | 2.19 | 0.38 |

*Sample of this invention
**Comparison sample

From the above results, it can be seen that when the compound is incorporated in a protective layer of the light-sensitive material, the compound also shows a high development stopping effect.

EXAMPLE 7

In 20 ml of cyclohexanone were added 10 g of Dye Providing Material (16), 0.5 g of succinic acid 2-ethylhexyl ester sodium sulfonate, and 10 g of tricresyl phosphate and the mixture was heated to 60° C. to form a uniform solution. The solution was mixed with 100 g of a 10% aqueous solution of gelatin followed by dispersion using a homogenizer to form a dispersion.

Then, Light-Sensitive Material 701 was prepared as follows.

| | |
|---|---|
| (a) Silver iodobromide emulsion as in Example 1 | 5.5 g |
| (b) 10% Aqueous gelatin solution | 0.5 g |
| (c) The aforesaid dispersion of Dye Providing Material (16) | 2.5 g |
| (d) Ethanol solution of 10% guanidine trichloroacetate | 1 ml |
| (e) Methanol solution of 10% 2,6-dichloro-4-aminophenol | 0.5 ml |
| (f) 5% Aqueous solution of the compound having the following structure | 1 ml |
| 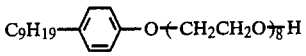 | |
| (g) Gelatin dispersion of Compound (8) as in Example 1 | 1 g |
| (h) Water | 6 ml |

After mixing the above components (a) to (h) under heating to dissolve solid components, the solution was coated on a polyethylene terephthalate film at a wet thickness of 85 μm and dried. Then, an aqueous gelatin solution was coated thereon as a protective layer at a gelatin coverage of 1.5 g/m$^2$ to provide Light-Sensitive Material 701.

The light-sensitive material thus prepared was treated as in Example 1 and measured. The results are shown in Table 7.

TABLE 7

| Light-Sensitive Material | Heating for 30 Sec. at 140° C. | | Heating for 40 Sec. at 140° C. | |
|---|---|---|---|---|
| | Maximum Density | Minimum Density | Maximum Density | Minimum Density |
| 701 | 1.81 | 0.13 | 1.91 | 0.20 |

From the above result, it can be seen that in a light-sensitive material containing a dye providing material capable of releasing a dye by the coupling reaction with the oxidation product of a developing agent, the compound of this invention shows a remarkable effect.

EXAMPLE 8

To 20 ml of cyclohexanone were added 5 g of Dye Providing Material (17) having the structure shown below, 4 g of the electron donor having the following structure shown below, 0.5 g of succinic acid 2-ethylhexyl ester sodium sulfonate, and 10 g of tricresyl phosphate and the mixture was heated to about 60° C. to from a solution. Then, by following the same procedure as in Example 7 using the solution thus prepared, a dispersion of the reducible dye providing material was prepared.

Dye Providing Material (17):

-continued

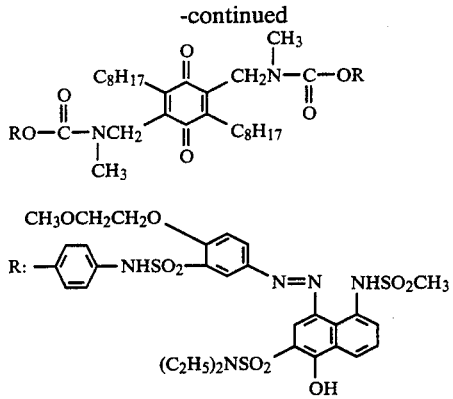

Electron Donor:

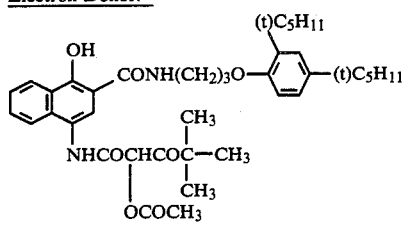

Then, by following the same procedure as in the case of preparing Light-Sensitive Material 701 in Example 7, except that the dispersion of the aforesaid reducible dye providing material was used in place of the dispersion of Dye Providing Material (16), Light-Sensitive Material 801 was prepared.

The light-sensitive material thus prepared was treated and measured as in Example 1 and the results obtained are shown in Table 8.

TABLE 8

| Light-Sensitive Material | Heating for 30 Sec. at 140° C. | | Heating for 40 Sec. at 140° C. | |
|---|---|---|---|---|
| | Maximum Density | Minimum Density | Maximum Density | Minimum Density |
| 801 | 1.60 | 0.16 | 1.65 | 0.21 |

From the above result, it can be seen that in the light-sensitive material containing the aforesaid reducible dye providing material capable of forming positive images with respect to the silver image, the compound of this invention is also effective.

EXAMPLE 9

Preparation of gelatin dispersion of coupler

To 30 ml of ethyl acetate were added 5 g of 2-dodecylcarbamoyl-1-naphthol (Dye Providing Material), 0.5 g of succinic acid 2-ethylhexyl ester sodium sulfonate, and 2.5 g of tricresyl phosphate to form a solution. The solution was mixed with 100 g of a 10% aqueous gelatin solution with stirring and the mixture was treated in a homogenizer for 10 minutes at 10,000 rpm to form a dispersion.

Then, Light-Sensitive Material 901 was prepared as follows.

| | |
|---|---|
| (a) Silver iodobromide emulsion (same as in Example 1) | 10 g |
| (b) The aforesaid dispersion of Dye Providing Material | 3.5 g |
| (c) Solution of 0.25 g of guanidine | |

-continued

| | |
|---|---|
| trichloroacetate dissolved in 2.5 ml of ethanol | |
| (d) 10% Aqueous gelatin solution | 5 g |
| (e) Solution of 0.2 g of 2,6-dichloro-p-aminophenol dissolved in 15 ml of water | |
| (f) Gelatin dispersion of Compound (8) of this invention (same as in Example 1) | 2 ml |

The coating liquid having the above composition was coated on a polyethylene terephthalate film at a wet thickness of 60 μm and dried to provide Light-Sensitive Material 901.

The light-sensitive material was imagewise exposed using a tungsten lamp for 5 seconds at 2,000 lux. Thereafter, the light-sensitive material was uniformly heated on a heat block heated at 150° C. for 20 seconds or 30 seconds, whereby a negative cyan image was obtained. The density was measured using a Macbeth densitometer (TD-504) and the results obtained are shown in Table 9.

TABLE 9

| Light-Sensitive Material | Heating for 20 Sec. at 150° C. | | Heating for 30 Sec. at 150° C. | |
|---|---|---|---|---|
| | Maximum Density | Minimum Density | Maximum Density | Minimum Density |
| 901 | 2.02 | 0.23 | 2.12 | 0.32 |

From the above result, it can be seen that the compound of this invention has an excellent development stopping effect.

EXAMPLE 10

Black-and-white example is explained.

Light-Sensitive Material 1001 was prepared as follows.

| | |
|---|---|
| (a) Silver iodobromide emulsion (same as in Example 1) | 1 g |
| (b) Benzotriazole silver salt (same as in Example 1) | 10 g |
| (c) Ethanol solution of 10% guanidine trichloroacetate | 1 ml |
| (d) Methanol solution of 5% compound having the following structure: | 2 ml |

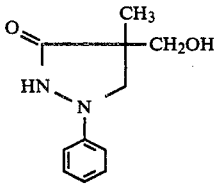

| | |
|---|---|
| (e) Gelatin dispersion of Compound (8) of this invention (same as in Example 1) | 1 ml |

The coating liquid of the above composition was coated on a polyethylene terephthalate film at a wet thickness of 60 μm, and dried to provide Light-Sensitive Material 1001.

The light-sensitive material was imagewise exposed using a tungsten lamp for 5 seconds at 2,000 lux. Thereafter, the light-sensitive material was uniformly heated on a heat block heated to 130° C. for 30 seconds or 40 seconds, whereby a negative brown image was measured. The density was measured using a Macbeth densitometer (TD-504), and the results obtained are shown in Table 10.

TABLE 10

| Light-Sensitive Material | Heating for 30 Sec. at 130° C. | | Heating for 40 Sec. at 130° C. | |
|---|---|---|---|---|
| | Maximum Density | Minimum Density | Maximum Density | Minimum Density |
| 1001 | 0.72 | 0.15 | 0.78 | 0.12 |

From the above result, it can be seen that the compound of this invention has an excellent development stopping effect.

While the invention has been described in detail and with reference to specific embodiments thereof, it will be apparent to one skilled in the art that various changes and modifications can be made therein without departing from the spirit and scope thereof.

What is claimed is:

1. A heat developable light-sensitive material comprising a support having thereon a light-sensitive silver halide emulsion, a base or a base precursor, a reducing agent and a compound in an amount capable of effectively stopping heat development of said heat developable light-sensitive material by reacting with a base generated by said base or said base precursor, said compound contains a group bonded to a carbon atom which is represented by formula (I)

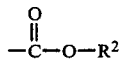

(I)

wherein $R^2$ represents an aryl group, a substituted aryl group, a heterocyclic group or a group represented by formula (A), (B), or (C)

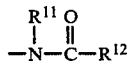

(A)

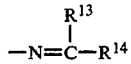

(B)

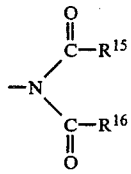

(C)

wherein $R^{11}$ through $R^{16}$ each represents an alkyl group, a substituted alkyl group, an aryl group, or a substituted aryl group, wherein said carbon atom is included in an alkyl group, a substituted alkyl group, a cycloalkyl group, an alkenyl group, an alkynyl group, and aralkyl group, and aryl group, a substituted aryl group, or a heterocyclic group.

2. A heat developable light-sensitive material as in claim 1, wherein the compound containing a group represented by formula (I) contains from 1 to 3 groups represented by formula (I).

3. A heat developable light-sensitive material as in claim 1, wherein the compound containing a group represented by formula (I) contains from 1 to 3 groups represented by formula (I).

4. A heat developable light-sensitive material as in claim 1, wherein the group represented by formula (I) is bonded to a carbon atom included in a straight chain or branched chain, unsubstituted or substituted alkyl group containing from 1 to 18 carbon atoms.

5. A heat developable light-sensitive material as in claim 1, wherein the group represented by formula (I) is bonded to a carbon atom included in a 5-membered or 6-membered cycloalkyl group having a total of from 5 to 10 carbon atoms.

6. A heat developable light-sensitive material as in claim 1, wherein the group represented by formula (I) is bonded to a carbon atom included in an alkenyl group selected from a vinyl group, an allyl group, a crotyl group, or a substituted or unsubstituted styryl group.

7. A heat developable light-sensitive material as in claim 1, wherein the group represented by formula (I) is bonded to a carbon atom included in an alkynyl group selected from a propionyl group, or a substituted or unsubstituted phenylpropionyl group.

8. A heat developable light-sensitive material as in claim 1, wherein the group represented by formula (I) is bonded to a carbon atom included in an aralkyl group selected from a benzyl group or a $\beta$-phenethyl group.

9. A heat developable light-sensitive material as in claim 1, wherein the group represented by formula (I) is bonded to a carbon atom included in an unsubstituted aryl group containing from 6 to 18 carbon atoms.

10. A heat developable light-sensitive material as in claim 1, wherein the group represented by formula (I) is bonded to a carbon atom included in a 5-membered or 6-membered heterocyclic ring group containing at least one of oxygen, nitrogen, or sulfur as a hetero atom.

11. A heat developable light-sensitive material as in claim 1, wherein the light-sensitive material contains a dye-providing material.

12. A heat developable light-sensitive material as in claim 11, wherein the dye-providing material is a compound represented by formula (C I):

$$(\text{Dye}—\text{X})_q—\text{Y} \qquad \text{(C I)}$$

wherein Dye represents a dye which becomes mobile when it is released from the molecule of the compound represented by formula (C I); X represents a simple bond or a connecting group; Y represents a group which releases Dye in correspondence or countercorrespondence to light-sensitive silver salts having a latent image distributed imagewise, the diffusibility of Dye released being different from the diffusibility of the compound represented by formula (C I); and q represents an integer of 1 or 2.

13. A heat developable light-sensitive material as in claim 1, wherein the compound containing a group bonded to a carbon atom which is represented by formula (I) is present as fine particles dispersed in a binder.

14. A heat developable light-sensitive material as in claim 11, wherein the compound containing a group bonded to a carbon atom which is represented by formula (I) and the dye-providing material are independently dispersed in a binder.

* * * * *